US010703097B2

(12) United States Patent
Hayashi et al.

(10) Patent No.: US 10,703,097 B2
(45) Date of Patent: Jul. 7, 2020

(54) INKJET RECORDER AND METHOD OF DETECTING MALFUNCTION

(71) Applicant: KONICA MINOLTA, INC., Chiyoda-ku, Tokyo (JP)

(72) Inventors: Kyohei Hayashi, Hachioji (JP); Akira Takeya, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/014,456

(22) Filed: Jun. 21, 2018

(65) Prior Publication Data

US 2018/0370227 A1 Dec. 27, 2018

(30) Foreign Application Priority Data

Jun. 22, 2017 (JP) ..... 2017-121815
Jun. 29, 2017 (JP) ..... 2017-127171

(51) Int. Cl.

| | |
|---|---|
| ***B41J 2/045*** | (2006.01) |
| ***B41J 29/38*** | (2006.01) |
| ***B41J 13/00*** | (2006.01) |
| *B41J 2/175* | (2006.01) |

(52) U.S. Cl.

CPC ..... *B41J 2/04581* (2013.01); *B41J 2/0451* (2013.01); *B41J 2/04541* (2013.01); *B41J 2/04588* (2013.01); *B41J 13/00* (2013.01); *B41J 29/38* (2013.01); *B41J 2/175* (2013.01)

(58) Field of Classification Search

CPC .. B41J 2/04581; B41J 2/0451; B41J 2/04588; B41J 2/04541; B41J 2/175

See application file for complete search history.

(56) References Cited

U.S. PATENT DOCUMENTS

2012/0007910 A1* 1/2012 Lee ..... B41J 2/0451 347/19
2015/0070420 A1 3/2015 Shinkawa

FOREIGN PATENT DOCUMENTS

JP 2008-062513 A 3/2008
JP 2015-051606 A 3/2015

* cited by examiner

*Primary Examiner* — Sharon A. Polk
(74) *Attorney, Agent, or Firm* — Buchanan Ingersoll & Rooney PC

(57) ABSTRACT

An inkjet recorder includes at least one nozzle ejecting ink, at least one piezoelectric element, a power unit, and a processor. The at least one piezoelectric element deforms in response to an applied voltage and causing a change in pressure of ink to be supplied to the nozzle. The power unit supplies power for application of a driving voltage to the piezoelectric element. The processor cyclically applies the driving voltage in accordance with a predetermined driving voltage pattern to the piezoelectric element, acquires a representative value corresponding to the power supplied by the power unit in response to the application of the driving voltage, and detects an abnormal capacitance of the piezoelectric element determined based on the representative value.

29 Claims, 10 Drawing Sheets

INKJET RECORDER AND METHOD OF DETECTING MALFUNCTION

CROSS-REFERENCE TO RELATED APPLICATIONS

Japanese Patent Application No. 2017-121815 filed on Jun. 22, 2017, and Japanese Patent Application No. 2017-127171 filed on Jun. 29, 2017, including description, claims, drawings, and abstract of the entire disclosure are incorporated herein by reference in its entirety.

BACKGROUND

Technological Field

The present invention relates to an inkjet recorder and a method of detecting a malfunction.

Description of the Related Art

A typical inkjet recorder ejects ink from nozzles onto a medium, to record images and structures. An inkjet recorder usually includes many nozzles. Ejection failure of such nozzles and/or uneven ejection among such nozzles reduces the quality of recording.

Such ejection failure and/or uneven ejection are caused by failure and/or deterioration of pressure generators that apply pressure to ink and/or the driving circuits of such pressure generators. Japanese Patent Application Laid-Open Publication No. 2008-62513 discloses a technique of detecting such failure and/or deterioration that detects the resistance of a driving circuit and abnormal capacitance of piezoelectric elements on the basis of the rising rate of voltages applied to the pressure generators or piezoelectric elements. Japanese Patent Application Laid-Open Publication No. 2015-51606 discloses a technique of detecting the vibration due to an electromotive force corresponding to a residual vibration of a piezoelectric element caused by the characteristic vibration of a diaphragm defining a sidewall of an ink channel generated by deformation of the piezoelectric element, to determine appropriate operation of the piezoelectric element.

However, the piezoelectric element used for an ink ejection operation has a significantly small capacitance. Thus, in the case where a voltage is applied to each piezoelectric element, the variation in voltage and current can be acquired at a sufficient resolution only through a configuration, control, and a detection process that are more complex than those of the related art. Thus, it is difficult to readily identify an abnormal driving operation for ink ejection from nozzles.

SUMMARY

An object of the present invention is to provide an inkjet recorder that can readily identify a malfunction in the driving operation for ink ejection and a method of detecting a malfunction.

To achieve at least one of the abovementioned objects, according to an aspect of the present invention, an embodiment reflecting one aspect of the present invention includes an inkjet recorder including:

at least one nozzle ejecting ink;

at least one piezoelectric element deforming in response to an applied voltage and causing a change in pressure of ink to be supplied to the nozzle;

a power unit supplying power for application of a driving voltage to the piezoelectric element; and a processor cyclically applying the driving voltage in accordance with a predetermined driving voltage pattern to the piezoelectric element, acquiring a representative value corresponding to the power supplied by the power unit in response to the application of the driving voltage, and detecting an abnormal capacitance of the piezoelectric element determined based on the representative value.

An embodiment reflecting another aspect of the present invention includes a method of detecting a malfunction of an inkjet recorder including a nozzle ejecting ink; a piezoelectric element deforming in response to an applied voltage and applying varied pressure to the ink supplied to the nozzle; and a power unit supplying power for application of a driving voltage to the piezoelectric element, the method including a malfunction detection steps of:

cyclically applying a driving voltage in accordance with a predetermined driving voltage pattern to the piezoelectric element;

acquiring a representative value corresponding to a variable component in a predetermined low frequency band among power supplied by the power unit in association with application of the driving voltage; and detecting an abnormal capacitance in the piezoelectric element based on the representative value.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Embodiments of the present invention will now be described with reference to the accompanying drawings. The embodiments should not be construed to limit the scope of the invention.

Figure 1:
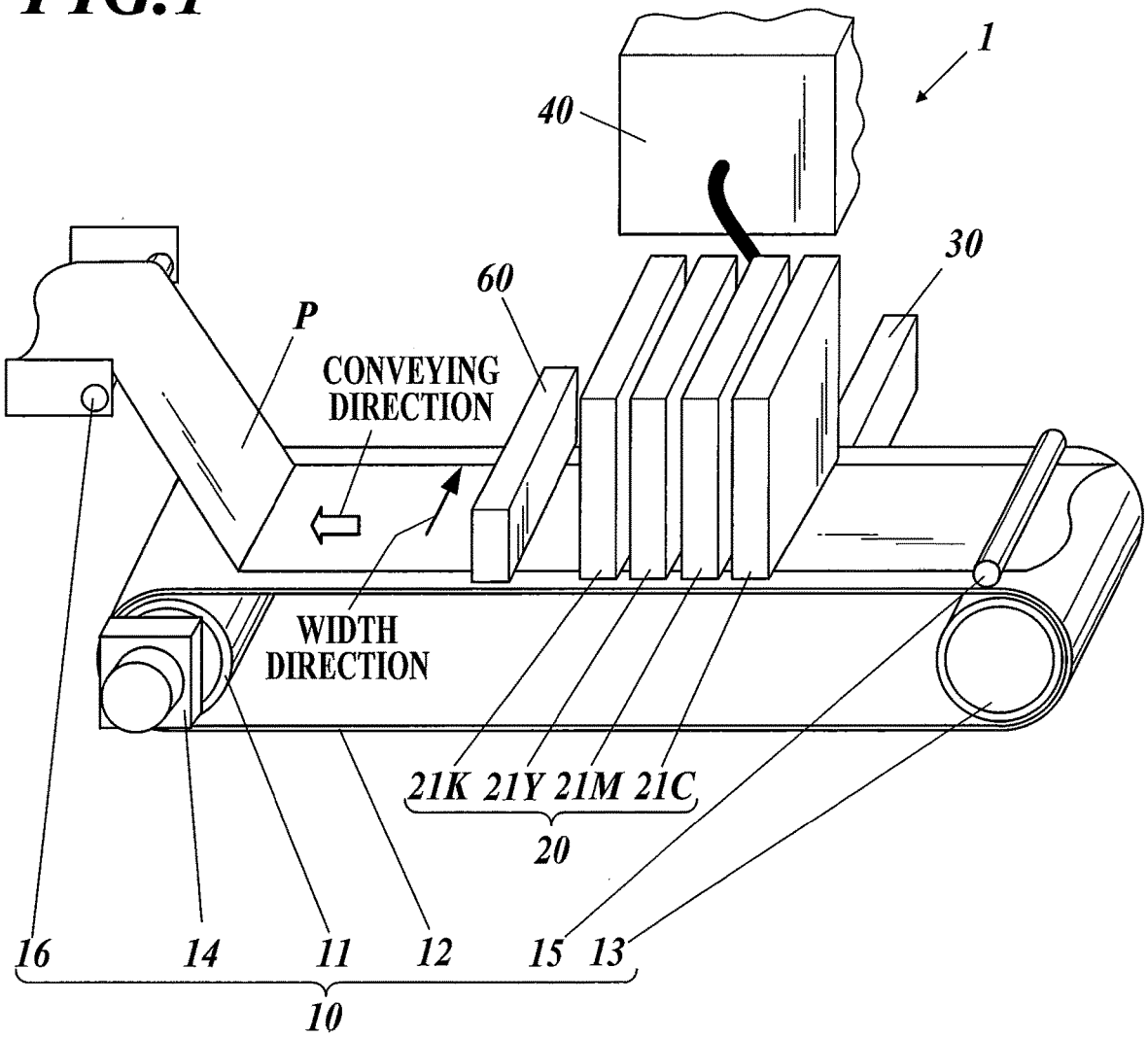
FIG. 1 illustrates the overall configuration of an inkjet recorder according to an embodiment of the present invention.

FIG. 1 is an overall perspective view of an inkjet recorder 1 according to an embodiment of the present invention.

The inkjet recorder 1 includes a conveyor 10, an image recorder 20, a cleaner 30, a controller 40, and a reader 60.

The conveyor 10 includes a driving roller 11, a conveyor belt 12, a driven roller 13, a conveyor motor 14, a pressing roller 15, and a separating roller 16. The endless conveyor belt 12 extends between the driving roller 11 and the driven roller 13 and rotates as the driving roller 11 driven by the conveyor motor 14. The circumferential face or conveying face of the conveyor belt 12 moves relative to the image recorder 20 in the conveying direction, to convey a recording medium P placed on the conveying face in the conveying direction. The conveyor belt 12 is composed of a material that can flexibly conform to the contact faces of the driving roller 11 and the driven roller 13 and certainly supports the recording medium P. Examples of such material are resin, such as rubber, or steel. The conveyor belt 12, which is composed of a material and/or has a configuration that sucks the recording medium P to the face of the conveyor belt 12, allows the recording medium P to be stably placed on the conveyor belt 12. The conveyor belt 12 may further include a configuration for separating the recording medium P from the conveyor belt 12 at a position downstream of the image recorder 20 in the conveying direction.

The driven roller 13 rotates in cooperation with the movement of the conveyor belt 12.

The recording medium P may be composed of any material. An example of the recording medium P is a fabric extending in the conveying direction. Multiple images recorded on the recording medium P at predetermined intervals are dried and the recording medium P is wound or dropped while swinging, and/or cut by a finishing device (not shown).

The conveyor motor 14 rotates the driving roller 11 at a rotational rate in accordance with control signals from the controller 40. The conveyor motor 14 can also rotate the driving roller 11 in a direction opposite to the normal conveying direction. In this way, the conveyor belt 12 conveys the recording medium P at a conveying rate corresponding to the rotational rate of the driving roller 11.

The pressing roller 15 presses the recording medium P placed on the conveying face of the conveyor belt 12 against the conveying face to remove gaps between the recording medium P and the conveying face, which, for example, causes wrinkles.

The separating roller 16 pulls the recording medium P that is conveyed while being sucked to the recording medium P at a predetermined force, to separate the conveyor belt 12 from the conveying face and send the separated recording medium P to the finishing unit.

Figure 2:
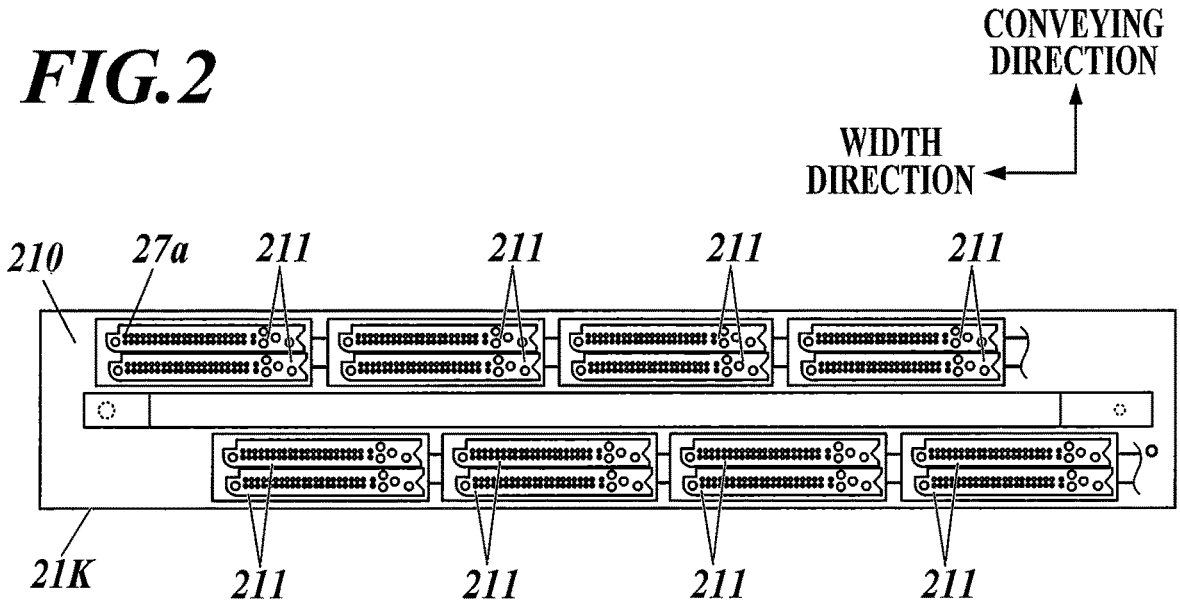
FIG. 2 is a schematic view of a nozzle face of a head unit.

The cleaner 30 cleans the face having nozzles 27 (see FIG. 3) and nozzle openings 27*a* (a nozzle face 210 facing the recording medium P placed on the conveying face) of the image recorder 20 (see FIG. 2). The cleaner 30 includes, for example, non-woven fabric or a blade to wipe off solidified ink and/or foreign objects on the nozzle face 210. The non-woven fabric or blade may contain or be provided with a wash solution, as required. The cleaner 30 may include an ink tray for collecting ink ejected during cleaning carried out to remove foreign objects and air bubbles in the nozzles by ejecting ink from the nozzles 27. The cleaner 30 faces the nozzle face and moves relative to the image recorder 20 during cleaning.

The controller 40 includes a processor that comprehensively controls the operation of the components of the inkjet recorder 1.

The reader 60 includes an image-capturing sensor and other components and captures and reads an image of the front face of the recording medium P (the face having recordings, in particular). The reader 60 captures an image of the front face of the recording medium P at a position downstream of the image recorder 20 in the conveying direction and upstream of the position of separation of the recording medium P from the conveyor belt 12 by the separating roller 16. The reader 60 can read the image recorded by the image recorder 20.

The image recorder 20 ejects ink from the nozzles 27 (see FIG. 3) onto the upper face of the recording medium P (the face remote from the conveying face), to record an image (image formation). The image recorder 20 includes multiple (four in this embodiment) head units 21Y, 21M, 21C, and 21K (hereinafter, some or all of the head units may be collectively referred to as "head units 21"). The head units 21 eject inks of different colors, for example, yellow, magenta, cyan, and black, from ink reservoirs (not shown). The head units 21, which eject ink, include nozzles 27 (see FIG. 3) on a plane parallel to the conveying face along the recordable width of the recording medium P having predetermined dimensions (maximum width mentioned above) intersecting (at a right angle in this embodiment) the conveying direction of the recording medium P.

FIG. 2 is a schematic view of the nozzle face of the head unit 21K.

Each of the head units 21C, 21M, and 21Y also has the same configuration, and thus description thereof is omitted.

The bottom face of the head unit 21K is provided with multiple (16 in this embodiment) ejection heads 211 each having nozzle openings 27*a* (only one of the nozzle openings 27*a* is indicated by the reference sign) disposed at predetermined intervals (nozzle pitch), for example, approximately 70.6 μm corresponding to 360 dots per inch (dpi) in this embodiment. The ejection heads 211 are disposed in pairs along the width direction such that the nozzle openings 27*a* of the ejection heads 211 are staggered to achieve an overall recording resolution of 720 dpi (a nozzle pitch of approximately 35.3 μm) of image recording. The pairs of the ejection heads 211 are disposed in a staggered pattern to constitute a line head having the nozzle openings 27*a* disposed at equal intervals along the recordable width mentioned above.

The nozzle face of the head unit 21K is fixed in a state facing the conveying face during image recording, and inks are sequentially ejected at predetermined intervals along the conveying direction onto the recording medium P being conveyed, thereby recording an image in a single-pass operation. The recording resolution in the conveying direction, which is determined by factors such as the ejection frequency of the nozzles 27 and the conveying rate, may be 720 dpi, which may be the same as or may be a different from the resolution mentioned above.

Figure 3:
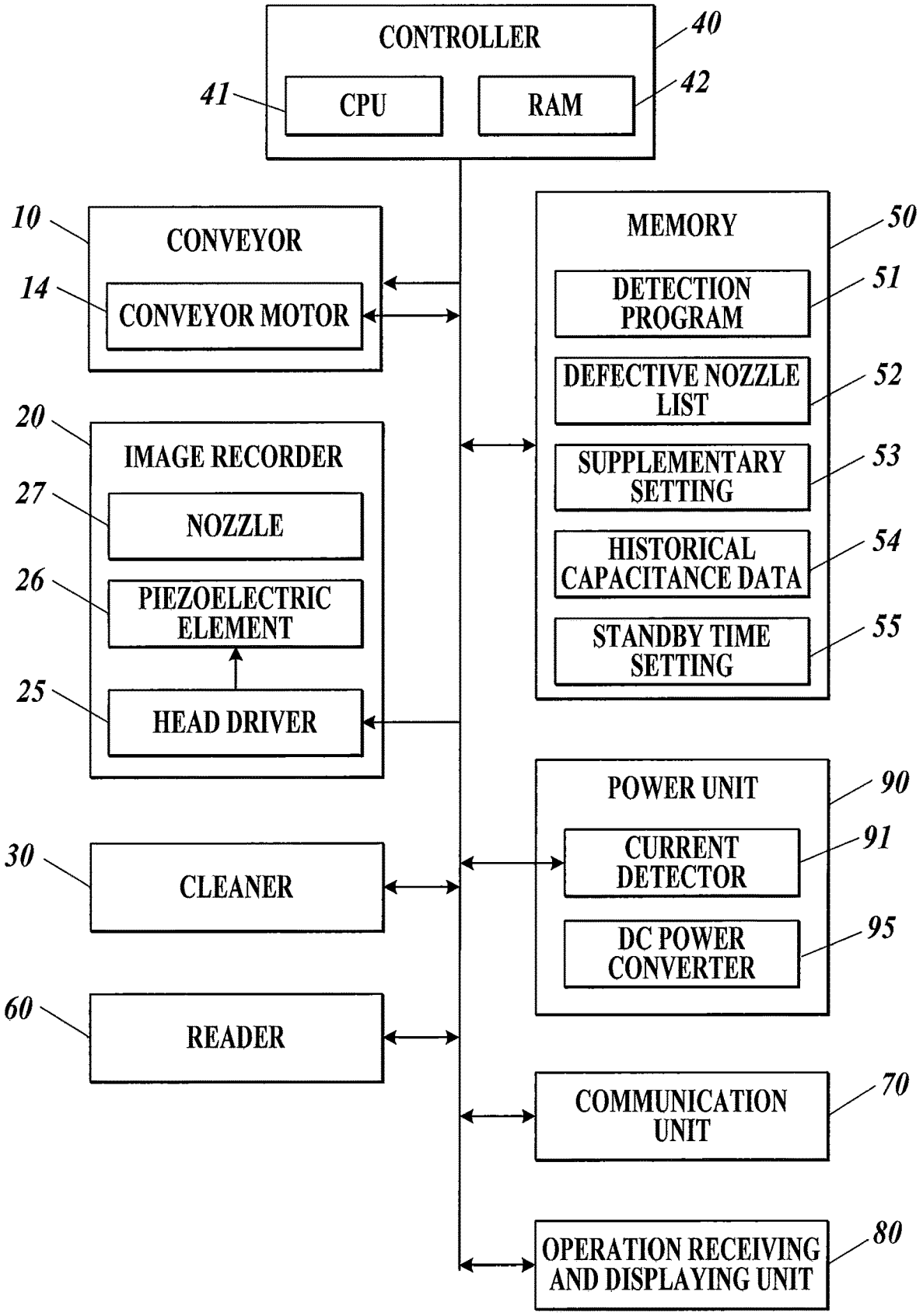
FIG. 3 is a block diagram illustrating the functional configuration of the inkjet recorder.

FIG. 3 is a block diagram illustrating the functional configuration of the inkjet recorder 1 according to this embodiment.

The inkjet recorder 1 includes a memory 50 (defective-nozzle storage, history storage), a communication unit 70, an operation receiving and displaying unit 80 (announcement unit) and a power unit 90, besides the conveyor 10, the image recorder 20, the cleaner 30, the controller 40, and the reader 60, mentioned above.

The controller 40 comprehensively controls the overall operation of the inkjet recorder 1. The controller 40 includes a CPU 41 and a RAM 42. The CPU 41 carries out various calculation processes and executes various instructions of control programs involving the control operation. The control operation includes a process of controlling the operation of the conveyor 10 and the image recorder 20 in accordance with the image data on a target image to be recorded (application of a driving voltage to piezoelectric elements 26) and recording the target image on a recording medium, a process of detecting malfunction of the piezoelectric elements 26 and/or the nozzles 27, and a process of operating the cleaner 30 in accordance with the detected results. The RAM 42 provides a work memory space for the CPU 41 and temporarily stores data. The RAM 42 may include a rewritable non-volatile memory, such as a flash memory.

The memory 50 stores various control programs, various data items, image data on target images to be recorded, and for processing the image data. The various control programs and data items may be stored in a non-volatile memory, such as a flash memory, and a hard disk drive (HDD). The data on the target images may be stored in a high-capacity non-volatile memory, such as a DRAM, that can be processed at high speed. The memory 50 includes a non-volatile memory and a DRAM. The control programs include a program 51 for detecting defective nozzles. The data items include a defective nozzle list 52 containing defective nozzles in correlation with or classified by the causes of the defect that are described below, a supplementary setting 53 of defective nozzles, historical capacitance data 54 of the piezoelectric elements 26 (history involving representative values of supplied power), and standby time setting 55 referred to during detection of malfunctions.

The conveyor 10 transports a recording medium on which an image is to be recorded to an image recording position of the image recorder 20 and ejects the recording medium after recording an image. The conveyor 10 moves and holds the recording medium at an appropriate image recording position relative to the image recorder 20. As described above, the conveyor 10 includes the conveyor motor 14 and moves the recording medium on the conveyor belt 12 by rotating the driving roller 11 at a predetermined rate.

The image recorder 20 ejects inks of the CMYK colors onto a recording medium transported by the conveyor 10 at image recording positions, to record an image. The ejection heads 211 of the image recorder 20 each includes an array of multiple nozzles 27 that eject ink, multiple piezoelectric elements 26 that are in communication with the respective nozzles 27 and deforms intermediate portions (pressure chambers) of ink channels supplying inks to the respective nozzles 27 to apply varied pressure to the ink, and head drivers 25 that apply voltages to the respective piezoelectric elements 26 to deform the piezoelectric elements 26. The piezoelectric elements 26 are composed of a known material, such as lead zirconate titanate (PZT). The piezoelectric elements 26 may have any deformation mode.

The cleaner 30 includes a non-woven fabric or a blade, as described above, and further includes a driver that moves the non-woven fabric or the blade relative to the nozzle face 210. Alternatively, the cleaner 30 may include a mechanism that moves the cleaner 30 in the conveying direction, so that the nozzle faces 210 of the head units 21 share the non-woven fabric or the blade and the ink tray.

The reader 60 includes an image-capturing sensor that captures images of the front face of a recording medium P at appropriate timings under the control of the controller 40 and outputs image-capturing data to the controller 40. The image-capturing sensor is, for example, a line sensor that can capture RGB color images. The image-capturing sensor repeats image capturing in synchronization with the transportation of the recording medium P and acquires a two-dimensional image.

The communication unit 70 controls transmission and reception of data between the inkjet recorder 1 and external units in accordance with a predetermined communication protocol. An example of the communication unit 70 is a network card that controls the TCP/IP connection through a LAN. Examples of external units that establish communication with the inkjet recorder 1 via the communication unit 70 include print servers and computers, such as personal computers (PCs) and portable terminals.

The operation receiving and displaying unit 80 includes an operation receiver that receives input operations from an external unit operated by a user and outputs the content of the received operation to the controller 40 in the form of electrical signals and a display that displays the status of the inkjet recorder 1, warnings, and menus involving the input operations by the user, under the control of the controller 40. The display is, for example, a liquid crystal display. The liquid crystal display is overlaid by a touch sensor and operates as a touch panel or operation receiver to receive input operations from the external unit. The operation receiving and displaying unit 80 may include other components, such as LED lamps and/or push-button switches. The operation receiving and displaying unit 80 may generate beeps or output sounds in cooperation with warning signs appearing on the display.

The power unit 90 supplies necessary power to the components of the inkjet recorder 1. The power unit 90 receives external power, converts the power into a DC voltage at a DC power converter 95, and outputs the DC voltage to the components. The DC power converter 95 is, for example, a typical DC/DC converter or a typical low-dropout (LDO) regulator.

The power unit 90 can output (supply) power having two different DC voltages VH1 and VH2 to the corresponding head driver 25 of the image recorder 20 for application of driving voltages to the piezoelectric elements, as described below. The power unit 90 includes a current detector 91 or ammeter that measures the current in a supply channel of the voltage VH2. The current detector 91 includes a resistive element having a predetermined resistance connected in series in a circuit and measures the current value (output current) on the basis of a voltage drop at the resistive element.

The circuitry involving application of voltage to a piezoelectric element 26 of the inkjet recorder 1 according to this embodiment will now be described.

Figure 4:
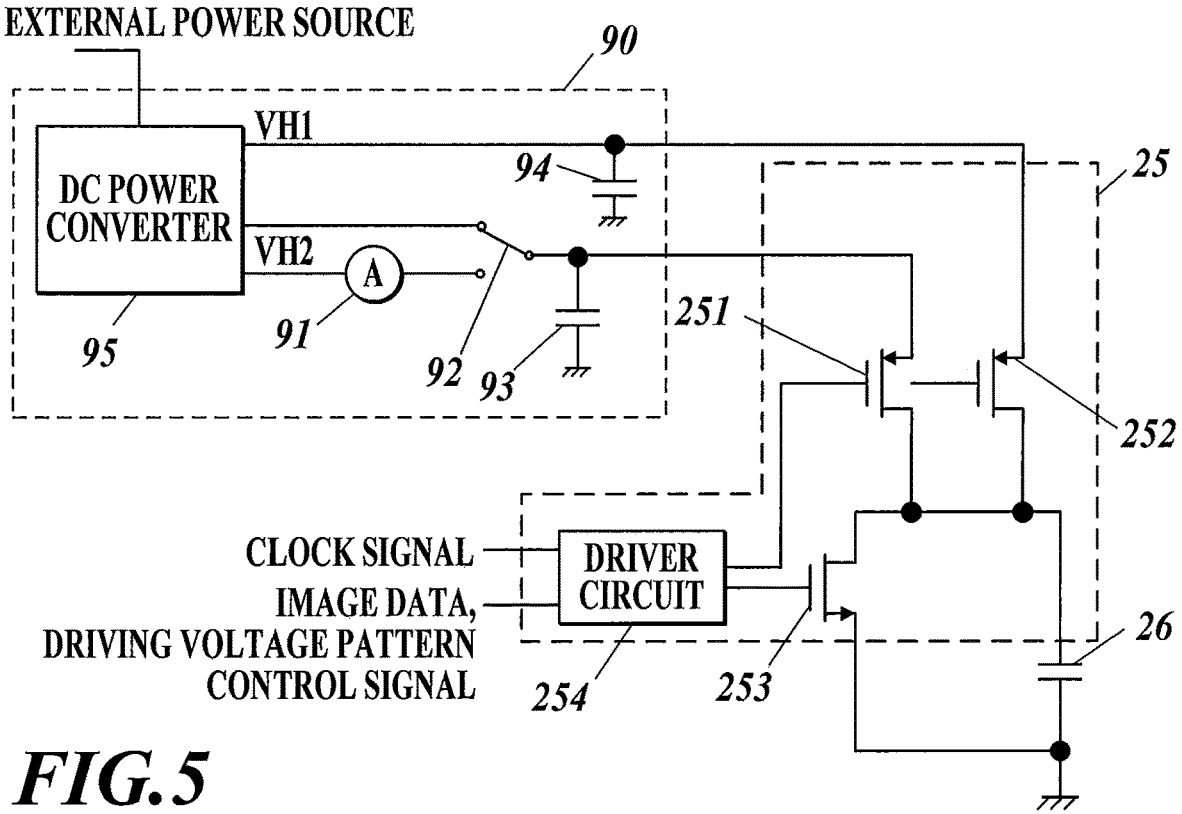
FIG. 4 is a schematic view of a power supply circuit of a power unit and an image recorder.

FIG. 4 is a schematic view of the power unit 90 and the power supply circuit of the image recorder 20 of the inkjet recorder 1 according to this embodiment. FIG. 4 illustrates the configuration involving power supply to a piezoelectric element 26 and a head driver 25 corresponding to one of the nozzles 27. Alternatively, power may be fed from a single source to the piezoelectric elements 26 and the head drivers 25 corresponding to the nozzles 27, and each head driver 25 may switch the voltage to be fed to the corresponding piezoelectric element 26.

The DC power converter 95 or driving-voltage outputting unit of the power unit 90 converts the power input from an external unit (for example, DC voltage of 24 V in this embodiment) to the voltage VH1 or VH2 (for example, 15 V). Two outputs of the voltage VH2 are provided in series; one output is directly fed (through a short circuit without a resistive element of the current detector 91) to a switching element 92 or second switch; and the other output is fed to the switching element 92 through a measurement circuit including the current detector 91 (and its resistive element). One of the outputs is fed to the head driver 25 depending on the state of the switching element 92. Alternatively, a single output of the voltage VH2 may be provided from the DC power converter 95 and may branch into a short circuit and a measurement circuit. In such a case, the switching element 92 is disposed at the branching point, and the short circuit and the measurement circuit may simply connect at the site corresponding to the switching element 92 in FIG. 4.

The voltage VH2 is fed from the switching element 92 to a first switch 251 of the head driver 25. One terminal of a first stabilizing capacitor 93 is connected to a node between the switching element 92 (a terminal of the resistive element of the current detector 91) and the first switch 251, and the other terminal of the first stabilizing capacitor 93 is grounded. The voltage VH1 is fed to a second switch 252 of the head driver 25. A second stabilizing capacitor 94 is connected to a node between the connecting terminal of the second switch 252 and the ground. One terminal of a third switch 253 of the head driver 25 is grounded. The capacitances of the first stabilizing capacitor 93 and the second stabilizing capacitor 94 are sufficiently higher than the capacitance of the piezoelectric element 26 so that power can be supplied to every piezoelectric element 26 without a reduction in the voltages of the first stabilizing capacitor 93 and the second stabilizing capacitor 94 and thus does not cause any abnormal driving operation.

A driver circuit 254 receives image data signals, control signals of driving voltage patterns described below, and predetermined clock signals. In response to each of these signals, one of the first switch 251, the second switch 252, and the third switch 253 is turned on (a period during which none of the switches are turned on may be provided before subsequently turning on another switch) to feed one of the voltages to a terminal of the piezoelectric element 26 (in the case where the third switch 253 is turned on, the electrical charge accumulated in the piezoelectric element 26 is discharged). The other terminal of the piezoelectric element 26 is grounded. In this way, the voltage is applied to the piezoelectric element 26. The voltage VH1 is an ejection voltage that causes ink to be ejected from the corresponding nozzle 27, and the voltage VH2 is a non-ejection voltage that is low enough to cause no ejection of ink from the nozzle 27 (it causes the liquid surface of the ink to merely vibrate in the nozzle 27).

Figure 5:
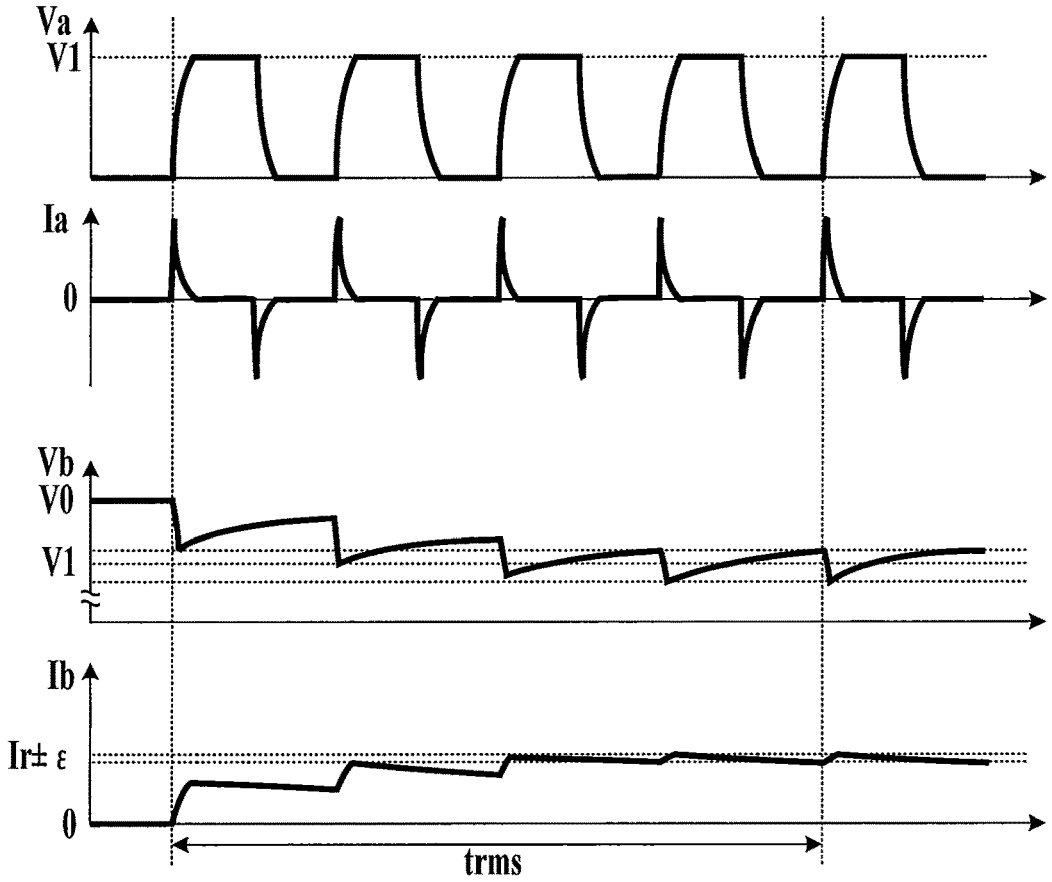
FIG. 5 illustrates variations in currents and voltages.

FIG. 5 illustrates variations in currents and voltages in each component.

In FIG. 5, the transitional states of the currents and voltages are exaggerated for illustrative purposes. The illustrated waveforms are not intended to indicate a specific quantitatively representative value.

Turning on of the first switch 251 or the second switch 252 causes a current Ia (>0) corresponding to the voltage and the capacitance of the piezoelectric element 26 to temporarily flow from the DC power converter 95 to a terminal of the piezoelectric element 26, which is a capacitative element, in accordance with a potential difference between the DC power converter 95 and the terminal of the piezoelectric element 26 until the voltage Va at the terminal of the piezoelectric element 26 becomes equal to the voltage Vb output from the DC power converter 95. Turning on of the third switch 253 causes a current Ia (<0) corresponding to the potential at the terminal of the piezoelectric element 26 to temporarily flow from the terminal of the piezoelectric element 26 to the ground until the voltage at the terminal of the piezoelectric element 26 equals the ground voltage.

Turning on (connection) of the first switch 251 or the second switch 252 causes currents to flow from the first stabilizing capacitor 93 or the second stabilizing capacitor 94 and the DC power converter 95 to the piezoelectric element 26. The magnitude of the currents corresponds to the voltage difference between the first stabilizing capacitor 93 or the second stabilizing capacitor 94 and the piezoelectric element 26 and the circuit resistance between the first stabilizing capacitor 93 or the second stabilizing capacitor 94 and the piezoelectric element 26, such as an ON resistance of the first switch 251 or the second switch 252. In specific, the voltage difference and the circuit resistance are time constants of the magnitude of the currents. The DC power converter 95 feeds a current corresponding to the output impedance. A predetermined magnitude is achieved through a sum of this current and currents from the first stabilizing capacitor 93 and the second stabilizing capacitor 94. The circuit resistance is sufficiently small compared to the output impedance; thus, most of the current Ia, which is large immediately after turning on the first switch 251 or the second switch 252, flows from the first stabilizing capacitor 93 or the second stabilizing capacitor 94. Electrical discharges from the first stabilizing capacitor 93 and the second stabilizing capacitor 94 cause the voltages of the first stabilizing capacitor 93 and the second stabilizing capacitor 94 to slightly decrease in accordance with the discharges.

When the first switch 251 and the second switch 252 are turned off (disconnected) after a driving voltage is applied to the piezoelectric element 26, the DC power converter 95 recharges the first stabilizing capacitor 93 and the second stabilizing capacitor 94. In the case of charge of the first stabilizing capacitor 93 through the current detector 91, the current detector 91 detects an output current Ib that is small and has a prolonged duration during recharge due to the time constant corresponding to the resistance of the resistive element of the current detector 91, which has a resistance higher than that of other circuit resistors (where the time constant is larger than the time constant involving discharge to the piezoelectric element 26).

In specific, the first switch 251 connects/disconnects the first stabilizing capacitor 93 and the piezoelectric element 26. The current detector 91 detects a predetermined low-frequency band (containing DC components) determined on the basis of the electric capacitance of the first stabilizing capacitor 93 and the resistance of the resistive element of the current detector 91 among the variable components (including the DC components) of the power supplied by the DC power converter 95 in response to the switching of charge/discharge of the first stabilizing capacitor 93 in accordance with the on/off state of the first switch 251.

Such a configuration reduces the decrease in the temporary voltage Vb due to an inrush current to the piezoelectric element 26 or the decrease in the voltage Va applied to the piezoelectric element 26 and outputs a current Ib (average current value Ir) having a small temporal variation in the current value from the DC power converter 95. The capacitances of the first stabilizing capacitor 93 and the second stabilizing capacitor 94 required for such a configuration are, in the case a driving voltage is simultaneously applied to all piezoelectric elements 26, normally sufficient for avoiding a reduction in the voltage Vb that impairs the ink ejection ability, i.e., larger by one to two digits than the product of the capacitance of each piezoelectric element 26 and the number of the piezoelectric elements 26.

Simultaneous application of the driving voltage VH2 for ink ejection through the resistive elements of the current detectors 91 to the piezoelectric elements 26 during image recording increases heat generation of the resistive elements depending on the number of piezoelectric elements 26 and requires an increase in the capacitance of the first stabilizing capacitors 93 to reduce the influence of the reduction in voltage. Thus, a switching element 92 may be provided such that the driving voltage bypasses the corresponding current detector 91 when measurement of the current is not required.

Detection of defective nozzles during ejection of ink from the inkjet recorder 1 according to this embodiment will now be described.

Defective nozzles 27 caused by degradation of the piezoelectric element 26 or disconnection of the driving circuit cannot be individually restored to a state of normal ejection of ink, whereas defective nozzles 27 caused by clogging or intrusion of air bubbles and/or foreign objects to the ink channels can be restored to a state of normal ejection of ink after cleaning or a restoration operation.

The inkjet recorder 1 outputs image data on a predetermined test image (ejection-failure testing image) to the driver circuits 254, periodically records the ejection-failure testing image, for example, in the margin of the recording medium P, and detects defects in the test image read at the reader 60, to determine (detect) an ejection failure of ink from the nozzles 27. A typical test chart is a ladder chart containing lines formed by the respective nozzles 27 such that the nozzles 27 are identifiable by the lines. In such a case, the nozzles 27 that have ejection failure are detected regardless of the cause of the failure.

In the inkjet recorder 1 according to this embodiment, the current detector 91 of the power unit 90 described above measures the output current Ib (a representative value corresponding to the supplied power), to determine defects in the piezoelectric element 26 and its driving circuit (i.e., electrical system). The defects in the selected piezoelectric element 26 and the driving circuit are detected such that the first switch 251 and the third switch 253 are alternatingly turned on in a predetermined switching cycle in response to a driving-voltage pattern controlling signal while the second switch 252 is turned off, to cyclically turn on/off the application of the driving voltage VH2, which is a non-ejection voltage, to the corresponding nozzle 27. This operation repeats the charge to and discharge from the selected piezoelectric element 26 based on a predetermined driving voltage pattern having a non-ejection waveform. The on/off cycle continues for a duration that is sufficient for charge to or discharge from the piezoelectric element 26. In other words, the minimum duration is determined by the circuit resistors, such as the ON resistance of the first switch 251 and the third switch 253, and the capacitance of the piezoelectric element 26. The circuit is configured such that a blunt waveform of the voltage applied to the piezoelectric element 26 due to the circuit resistor does not affect the operation of the piezoelectric element 26. Furthermore, it is preferred that the on/off switching cycle allow an appropriate charging current to continually flow in balance with the discharge of the piezoelectric element 26 without finishing the charge of the first stabilizing capacitor 93. For example, in the case where a voltage of approximately 15 V is applied to a piezoelectric element 26 having a capacitance within the range of 0.1 to 1.0 nF, the appropriate on/off switching frequency f for acquiring a measurable value of the output current Ib is approximately 10 kHz.

In detail, the work $E=Cp\cdot V1^2/2$ corresponding to the charge from a voltage "0" to a voltage V1 of the capacitance Cp of the piezoelectric element 26 (i.e., the electrostatic energy of the piezoelectric element 26 at the voltage V1) is repeated at the on/off switching frequency f per second of the first switch 251. Thus, the work per second or the electricity supplied by the DC power converter 95 is $E\cdot f\approx f(Ib\cdot Vb)dt\approx Ir\cdot V1$. Hence, the capacitance Cp of the piezoelectric element 26 is $Cp=2\cdot Ir/(V1\cdot f)\approx 2Ir/(V0\cdot f)$. The capacitance Cp is determined on the basis of a known applied voltage V0 (i.e., the voltage VH2), the on/off switching frequency f, and the average current value Ir of the measured output currents Ib. In the case where two piezoelectric elements 26 are simultaneously deformed in a shear mode, the capacitance can be determined to be two times the capacitance Cp of a piezoelectric element.

Actually, the current value of the measured output current Ib slightly fluctuates (by $\pm\varepsilon$ with proviso that the fluctuation is not necessarily equal in the positive and negative ranges) due to the influence of ripples. Thus, the average current value Jr is determined by measuring the output current Ib multiple times and calculating the average. In the case where the voltage VH2 and the switching frequency f are fixed values, the capacitance Cp is proportional to the average current value Jr and thus can be determined without calculation of the capacitance Cp.

As the voltage Vb of the first stabilizing capacitor 93 varies, the rate of charge/discharge (current) of the first stabilizing capacitor 93 also varies. The charging rate of the first stabilizing capacitor 93 is affected by the capacitance of the first stabilizing capacitor 93 and the circuit resistors, such as the internal resistor (resistance of the resistive element) of the current detector 91. The discharge of the first stabilizing capacitor 93 is affected by the configuration involving the charge of the piezoelectric element 26. A significantly high voltage Vb leads to a decreased charging rate compared to the discharging rate, and the voltage Vb gradually decreases. A significant low voltage Vb leads to an increased charging rate compared to the discharging rate, and the voltage Vb gradually increases. In the case where the on/off operation is continuously carried out at the switching frequency f, the voltage Vb of the first stabilizing capacitor 93 slightly decreases below the applied voltage V0 and stabilizes in the form of periodic fluctuation of a value (the equilibrium voltage V1) at which the discharging and charging rates are balanced. The reduction from the voltage V0 to the voltage V1 substantially nullifies the effect on the applied voltage (i.e., the deformation operation) of the piezoelectric element 26 in accordance with the capacitances of the first stabilizing capacitor 93 and the second stabilizing capacitor 94 while increasing the effect of the slight reduction on the charging/discharging rate of the first stabilizing capacitor 93 in accordance with the capacitances. Thus, the average charging current Ir can be measured at high accuracy during application of a voltage to the target piezoelectric element 26 through the current detector 91 at the switching frequency f after waiting for a predetermined standby time until the voltage Vb becomes substantially equal to the balanced value of the voltage V1, i.e., until the difference between the discharging rate and the charging rate becomes smaller than a reference value.

A predetermined standby time trms before inspection of the nozzles may be the actual time until the voltage Vb sufficiently approaches the voltage V1 and the fluctuation is within a predetermined range (for example, several %) or may be calculated with a preliminarily stored mathematical expression and selected parameters to determine the product of the capacitance of an RC circuit and the resistance. Alternatively, the measurements involving the standby time trms may be stored. The standby time trms is a fixed value determined generally on the basis of the response rate of the charge/discharge of the first stabilizing capacitor 93, i.e., the product of the capacitance of the first stabilizing capacitor 93, which determines the time constant, and the resistance of the resistor element of the current detector 91. The cyclic driving voltage waveform may be fed during initialization in association with pre-shipment inspection or replacement of the head units 21; and the actual time required for the fluctuation to stabilize within a predetermined reference range after start of the feed may be measured and stored in the memory 50 as the standby time setting 55. Alternatively, the first stabilizing capacitor 93 may have variable capacitance that varies the time constant. A reduction in capacitance leads to a decrease in time constant, and this causes a large fluctuation $\pm\varepsilon$ from the average current value Ir during measurement of the output current Ib. Thus, in such a case, the number of measurements of the output current Ib may be increased to enhance the precision of the average value. Alternatively, the resistance of the resistive element of the current detector 91 may be variable. In such a case, the detection precision of the current detector 91 should be maintained at a certain level. If the resistance can be set to zero or substantially zero, a virtual short circuit can be established in place of the short circuit described above.

If the first stabilizing capacitor 93 is not charged, for example, at start-up of the inkjet recorder 1, the time until the voltage of the first stabilizing capacitor 93 increases to approximately the voltage VH2 is extended, and the standby time trms differs greatly from that described above. Thus, a standby time trms for such a case may be stored separately, or the standby time may be set to the time until the fluctuation in the voltage of the first stabilizing capacitor 93 stabilizes within a predetermined reference range while the voltage is periodically measured.

With the piezoelectric element 26 calculated in this way, a capacitance Cp (i.e., the average current value Ir) of zero or significantly small compared to the reference range indicates the presence of defects, such as disconnection, somewhere between the DC power converter 95 and the piezoelectric element 26 (including the two terminals). In contrast, a significantly large capacitance Cp (the average current value Ir) compared to the reference range indicates a conductive defect, such as short-circuiting, due to, for example, degradation of the protective layer of an electrode caused by deformation or heat somewhere between the DC power converter 95 and the piezoelectric element 26.

The calculated capacitance Cp of the piezoelectric element 26 is compared with previous initial values and the calculation history (temporal change) in the historical capacitance data 54. A capacitance Cp exceeding the predetermined reference range indicates degradation of the piezoelectric element 26 (the degradation information is determined). The reference range may be the initial range preliminarily measured and stored during pre-shipment inspection or the average determined on the basis of the average current value Ir of several initial measurements. The reference range data is stored in the memory 50 or any other component. In the case where the capacitance Cp is estimated on the basis of the history (variation in measured time) to exceed the reference range at some early date, for example, within a predetermined number of days, a warning may be displayed even before the capacitance Cp actually exceeds the reference range.

Electrical defects (malfunctions), such as disconnection, short-circuiting, and degradation, detected on the basis of abnormal capacitances Cp cannot be individually restored and are saved as non-restorable defective nozzles in the defective nozzle list 52. In the case where several nozzles 27 commonly driven by the head driver 25 are degraded in similar degrees, the applied voltage V0 may be varied to achieve comprehensive adjustment. When presence or generation of a defective nozzle that cannot be individually restored is detected, the inkjet recorder 1 stops the drive of the defective nozzle 27 that ejects ink in response to deformation of the piezoelectric element 26 having an electrical defect. The nozzles 27 adjacent to the defective nozzle 27 are then operated to supplement the volume of ink that was to be ejected from the defective nozzle 27. The setting for this control of the adjacent nozzles 27 is stored as the supplementary setting 53. The nozzle openings 27*a* are two-dimensionally arrayed in the inkjet recorder 1 according to this embodiment. Thus, every nozzle 27 has three or four adjacent nozzles 27 in the width direction, except for the nozzles 27 at the two ends. However, every adjacent nozzle 27 need not to eject ink to supplement the defective nozzle 27; the ink that was to be ejected from the defective nozzle 27 may be supplemented by at least some of the nozzles 27 adjacent to the defective nozzle 27.

The defective nozzles that are not non-restorable (defective nozzles) among the nozzles 27 detected to have ejection failure through the test chart described above are determined to be restorable. When a small number of restorable defective nozzles 27 is detected, the supplementary setting described above is established. When the number of restorable defective nozzles 27 increases or when a predetermined condition occurs that causes difficulty in the supplementary operation, such as ejection failure of the nozzles 27 adjacent to the defective nozzle, the cleaner 30 cleans the nozzle face 210. Alternatively, the nozzle face 210 may be immediately cleaned in response to detection of one or more restorable defective nozzles 27 without the supplementary operation.

The process of detecting defects is periodically carried out at the start of the inkjet recorder 1 (start of power supply) and/or during an image recording operation. The process may also be carried out during halt of the image recording operation such as switching of print jobs.

Figure 6:
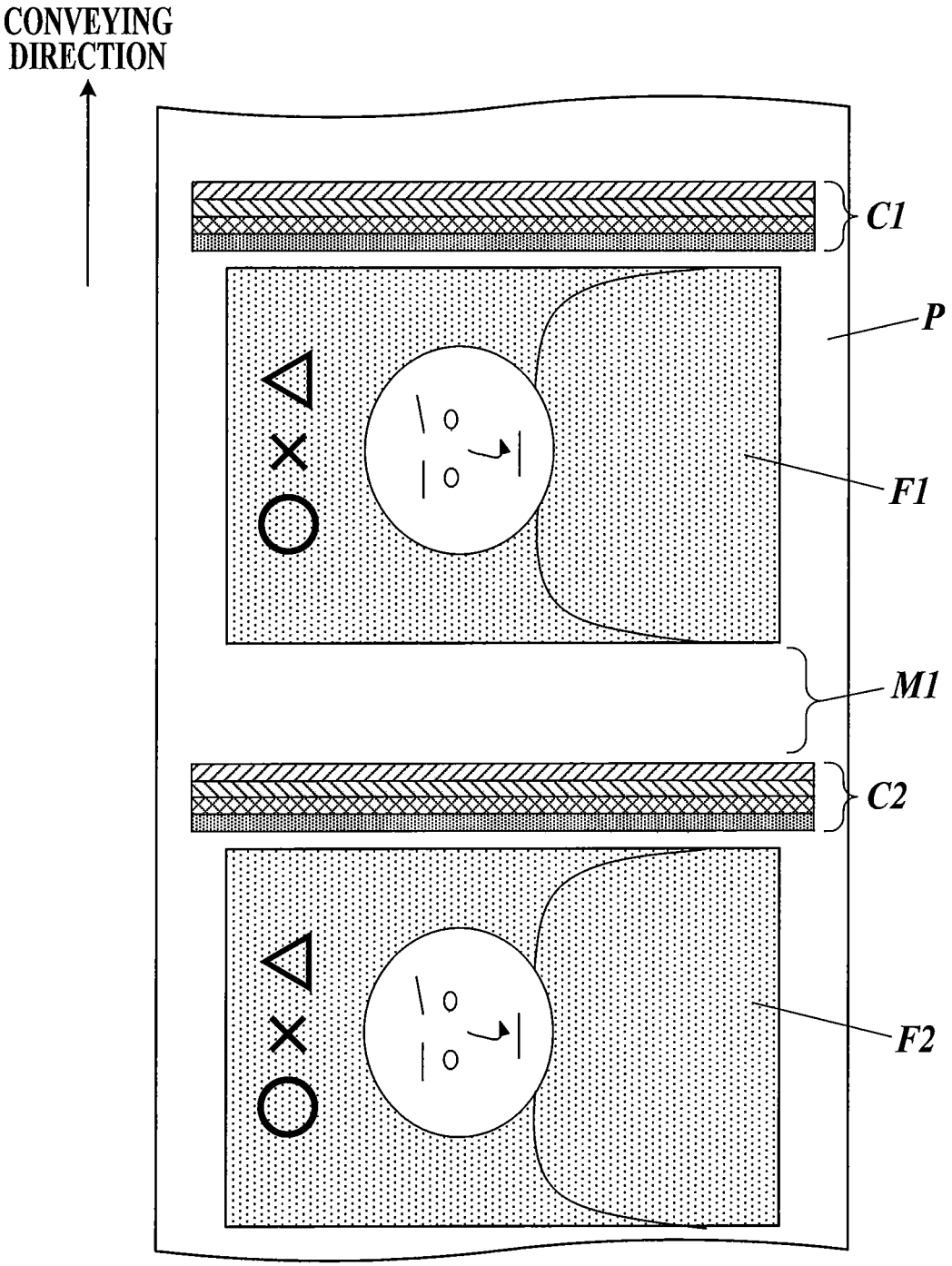
FIG. 6 illustrates an image recording position on a recording medium during an image recording operation.

FIG. 6 illustrates an image recording position on the recording medium P during an image recording operation.

When the recording operation is repeated to record consecutive target images F1 and F2 on a continuous recording medium P, test charts C1 and C2 each consisting of YMCK color strips are formed downstream of the target images F1 and F2 in the conveying direction. The test charts C1 and C2 are not necessarily required to detect all defective nozzles every time. That is, all defective nozzles may be detected through a combination of multiple test charts C1 and C2.

A small gap M1 is provided between the test chart C2 and the previous target image F1 at a position downstream of the test chart C2 in the conveying direction. A current measuring operation can be carried out to calculate the capacitances of the piezoelectric elements 26 while the gap M1 is being formed by interrupting ink ejection. The capacitances of all piezoelectric elements 26 need not be measured during the formation of one gap M1. The capacitances of the piezoelectric elements 26 may be calculated during current measurement operations carried out during the formation of several gaps; in other words, the current measurement may be dividing among several recording operations.

The nozzles 27 and the piezoelectric elements 26 may be categorized into groups, and ink ejection failures of the nozzles 27 and malfunctions of the piezoelectric elements 26 may be determined in each group instead of the determination of the ink ejection failure and malfunctions in the individual nozzles 27 and piezoelectric elements 26. When an ink ejection failure and/or malfunction is detected in a group, the nozzles 27 and the piezoelectric elements 26 in the group may be individually inspected to extract the nozzle(s) 27 having ink ejection failures and/or the malfunctioning piezoelectric element(s) 26.

Figure 7:
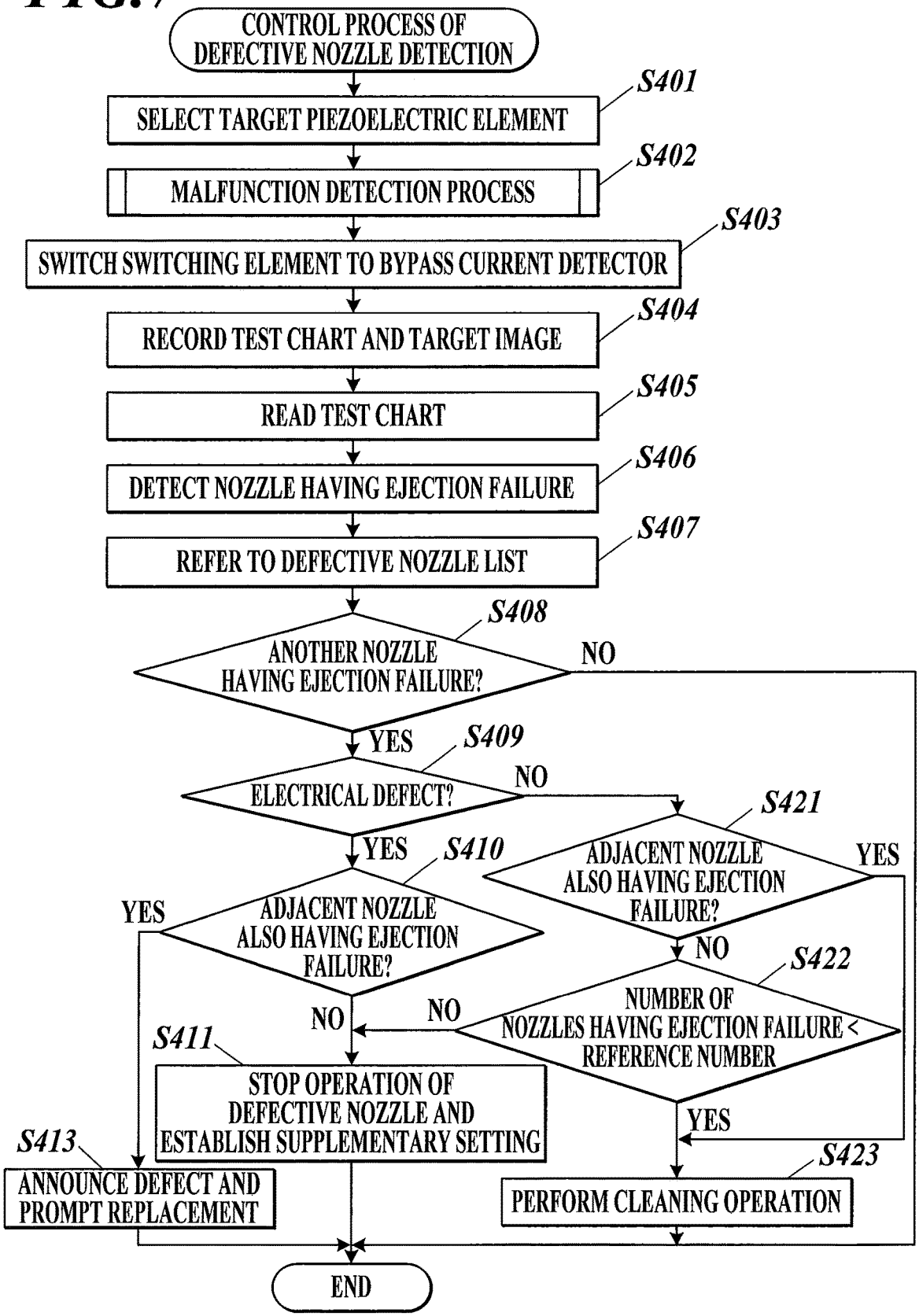
FIG. 7 is a flow chart illustrating the control process of defective nozzle detection.

FIG. 7 is a flow chart illustrating the control process of defective nozzle detection carried out by the controller 40 of the inkjet recorder 1 according to this embodiment.

After the start of the control process of defective nozzle detection, the controller 40 selects a target piezoelectric element to be inspected for defective nozzle (step S401). The controller 40 calls up to execute the malfunction detection process (step S402).

The controller 40 outputs a control signal to the power unit 90 and switches the switching element 92 to bypass the current detector 91 (step S403). The controller 40 records a test chart and a target image on the recording medium P (step S404). The controller 40 outputs control signals to the reader 60 in cooperation with the conveying of the recording medium P and reads the recorded test chart (step S405).

The controller 40 analyzes the read test chart and detects a nozzle having an ejection failure (step S406). The controller 40 acquires information on known defective nozzles in reference to the defective nozzle list 52 (step S407).

The controller 40 searches for a further nozzle having an ejection failure (step S408). If no failed nozzle is detected (NO in step S408), the controller 40 ends the control process of defective nozzle detection.

If a further nozzle having an ejection failure is detected (YES in step S408), the controller 40 determines whether the nozzle having an ejection failure is caused by an electric defect, i.e., whether the defect is detected in both the analysis of the test chart and the defect detection process (step s409). If the defective nozzle is caused by an electrical defect (YES in step S409), the nozzles adjacent to the defective nozzle in the width direction are inspected for ejection failure (step S410). If the adjacent nozzles have ejection failure or are under a certain condition (YES in step S410), the controller 40 instructs the operation receiving and displaying unit 80 and/or other components to announce the defect in a certain manner and prompt the replacement of the ejection head 211 or the head unit 21 containing the defect (step S413). The controller 40 then ends the control process of defective nozzle detection.

If the adjacent nozzles do not have ejection failures (NO in step S410), the controller 40 stops the operation of the defective nozzle and establishes the setting for supplementary ejection of the adjacent nozzles to supplement the ejection by the defective nozzles (step S411). The controller 40 then ends the control process of defective nozzle detection.

In step S409, if the defective nozzle is not caused by an electrical defect (NO in step S409), the controller 40 determines whether the nozzles adjacent to the defective nozzle in the width direction are also defective (step S421). If the adjacent nozzles are not defective (NO in step S421), the controller 40 determines whether the number of detected defective nozzles is smaller than a predetermined reference number (step S422). If the number is smaller than the reference number (NO in step S422), the controller 40 carries out step S411.

If the number is not smaller than a reference number (larger than or equal to the reference number) (YES in step S422), the controller 40 stops the image recording operation and instructs the cleaner 30 to clean the head units 21 including the defective nozzle(s) (step S423). The controller 40 then ends the control process of defective nozzle detection.

In step S421, if the adjacent nozzles include defective nozzles (YES in step S421), the controller 40 carries out step S423.

If multiple defective nozzles are detected in step S408, step S409 and the subsequent steps should be repeated. Steps S413 and S423 may be carried out after the processes for all defective nozzles are completed.

Figure 8:
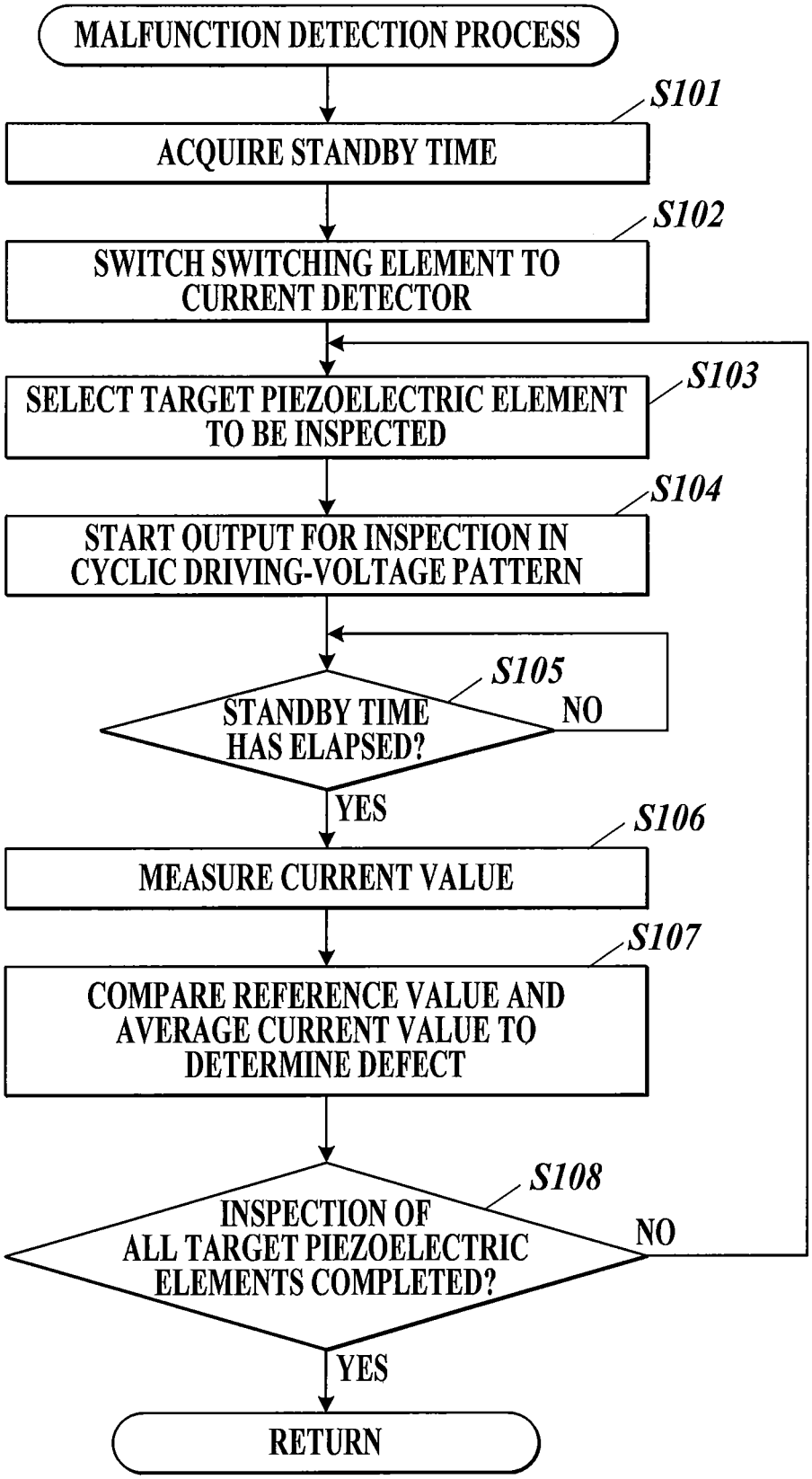
FIG. 8 is a flow chart illustrating the control process of malfunction detection.

FIG. 8 is a flow chart illustrating the control process for malfunction detection carried out by the controller 40 and called up during the control process of defective nozzle detection.

The process or method of detecting a malfunction in the inkjet recorder 1 according to this embodiment may be carried out independently from the control process of defective nozzle detection, for example, at start-up of the inkjet recorder 1, at predetermined time intervals during recording of images, and/or in a standby mode after completion of a print job involving image recording.

After the start of the malfunction detection process, the controller 40 acquires the standby time trms with reference to the standby time setting 55 (step S101). The controller 40 switches the switching element 92 to the measurement circuit and receive power through the current detector 91 (step S102).

The controller 40 selects a target piezoelectric element 26 (step S103). The controller 40 starts output of a voltage in a cyclic driving voltage pattern for inspection to the target piezoelectric element 26 (step S104). The controller 40 determines whether the standby time trms has elapsed from the beginning of the output (step S105). If the standby time trms has not elapsed (NO in step S105), the controller 40 repeats step S105.

If the standby time trms has elapsed (YES in step S105), the controller 40 acquires the measured output current Ib from the current detector 91 (step S106). If several output currents Ib are to be used for determining the average current value Ir, the controller 40 acquires the output current Ib several times at predetermined time intervals.

The controller 40 acquires the average current value Ir on the basis of the output currents Ib and compares the average current value Ir with a reference value to determine whether the average current value Ir (i.e., the capacitance Cp of the piezoelectric element 26) is an abnormal value (step S107). The controller 40 determines whether inspection (detection of defects) on all target piezoelectric elements 26 is completed (step S108). If the inspection is not completed (NO in step S108), the controller 40 carries out step S103. If the inspection is completed (YES in step S108), the controller 40 ends the malfunction detection process. The controller 40 switches the switching element 92 and the control signals for the output of the driving voltage, as required.

In step S103, only one piezoelectric element 26 is selected at once so that an abnormal capacitance Cp (malfunction) of the piezoelectric element 26 is immediately detected. When sufficient time is not available for step S103, such as between consecutive image recording operations, multiple piezoelectric elements 26 may be selected and inspected merely for an abnormal capacitance Cp. If an abnormal capacitance Cp is detected, each of the selected piezoelectric elements 26 may be inspected one by one to identify the defective piezoelectric element 26.

Figure 9:
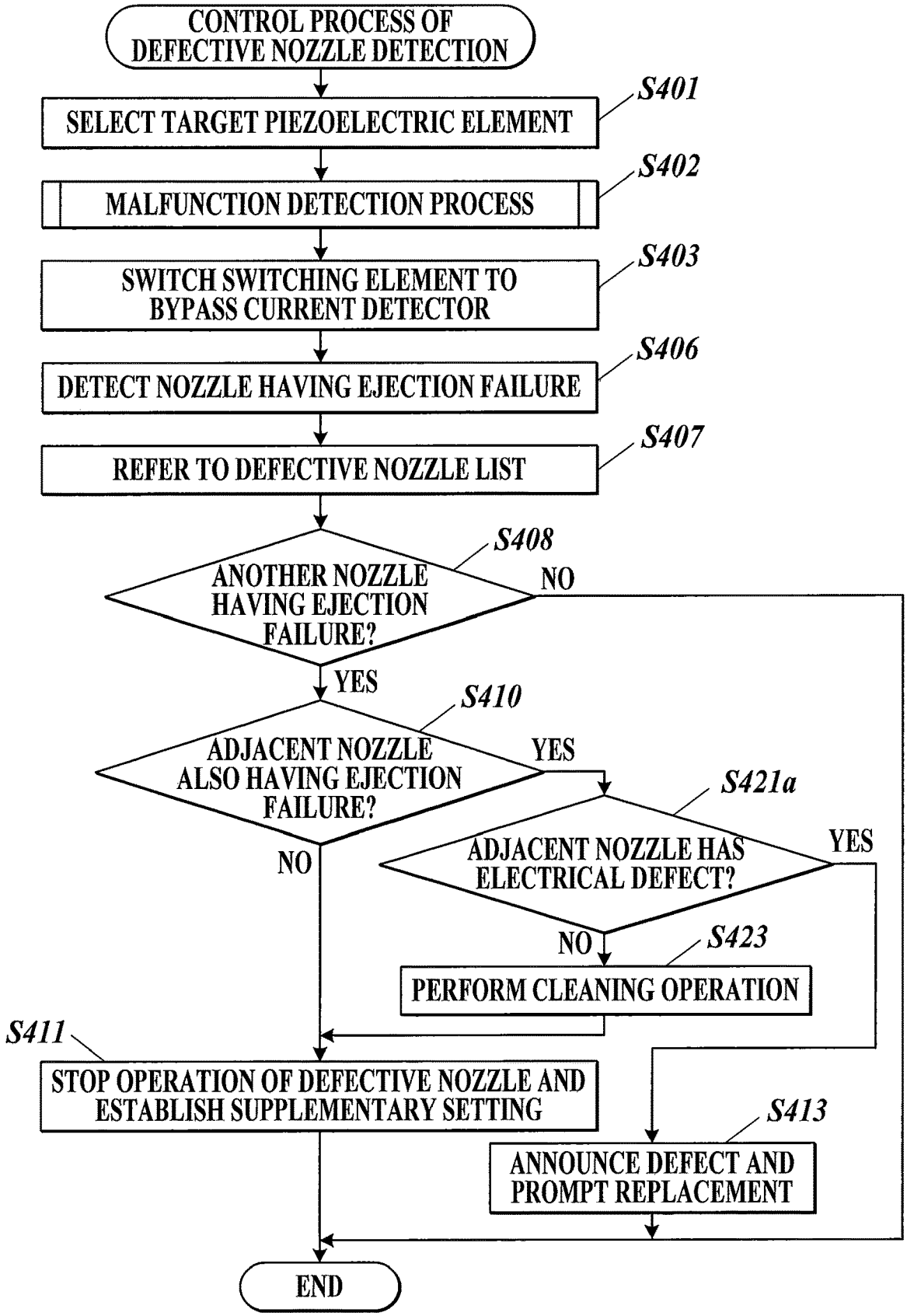
FIG. 9 is a flow chart illustrating another control process of defective nozzle detection.

FIG. 9 is a flow chart illustrating another control process of defective nozzle detection carried out by the controller 40.

This control process of defective nozzle detection should be carried out independently from the recording of the test chart during an intermission of the image recording operation, for example, at start-up of the inkjet recorder 1 or during switching of print jobs.

This control process of defective nozzle detection is the same as the control process of defective nozzle detection illustrated in FIG. 7 except that steps S404, S405, S409, and S422 are omitted and step S421 is replaced with step S421*a*. The other steps, which are the same as those illustrated in FIG. 7, are indicated by the same reference signs, and descriptions thereof are not repeated.

The controller 40 carries out step S403 and step S406. If "YES" in step S408, the controller 40 carries out step S410.

If "YES" in step S410, the controller 40 determines whether the defects of the adjacent nozzles are electrical defects (step S421*a*). If the defects are not electrical (NO in step S421*a*), the controller 40 carries out step S423. The controller 40 carries out step S411 after step S423.

In step S421*a*, if the defects of the adjacent nozzles are electrical (YES in step S421*a*), the controller 40 carries out step S413.

Modification

Power units 90 of inkjet recorders 1 according to modifications will now be described.

FIGS. 10A, 10B, 11A, 11B, 11C, 12A, and 12B illustrate the power units 90 according to modifications.

Figure 10A:
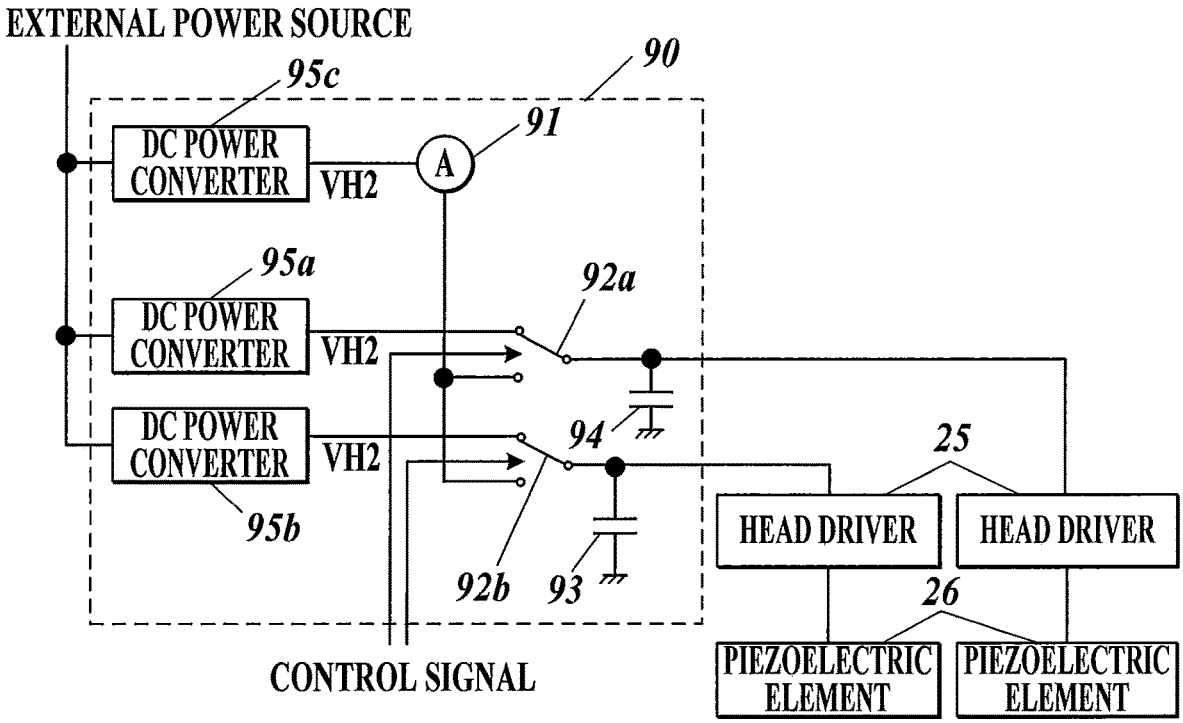
FIG. 10A illustrates a power unit according to a modification.

The power unit 90 according to a first modification illustrated in FIG. 10A includes a predetermined number of head drivers 25 corresponding to multiple groups of piezoelectric elements 26. The head drivers 25 output driving voltages VH2 to the corresponding piezoelectric element groups each containing a predetermined number of piezoelectric elements 26. The predetermined number of head drivers 25 (two in this modification) are provided with respective DC power converters, i.e., a first DC power converter 95*a* (first driving-voltage outputting unit) and a second DC power converter 95*b* (second driving-voltage outputting unit) and respective switching elements (input switches) 92*a* and 92*b*. A DC power converter 95*c* outputs a voltage VH2 to the switching elements 92*a* and 92*b* through a current detector 91. The description of the configuration involving the output of the voltage VH1 will be omitted.

The switching elements 92*a* and 92*b*, which are switchable in response to individual control signals, selectively switch between the DC power converters to supply a voltage VH2 to the head drivers 25 (selects the DC power converter to supply power). Thus, the current corresponding to the voltage VH2 outputted to some (or one in particular) of the head drivers 25 can be measured at the current detector 91, to determine the capacitance Cp of the corresponding piezoelectric element(s) 26.

Figure 10B:
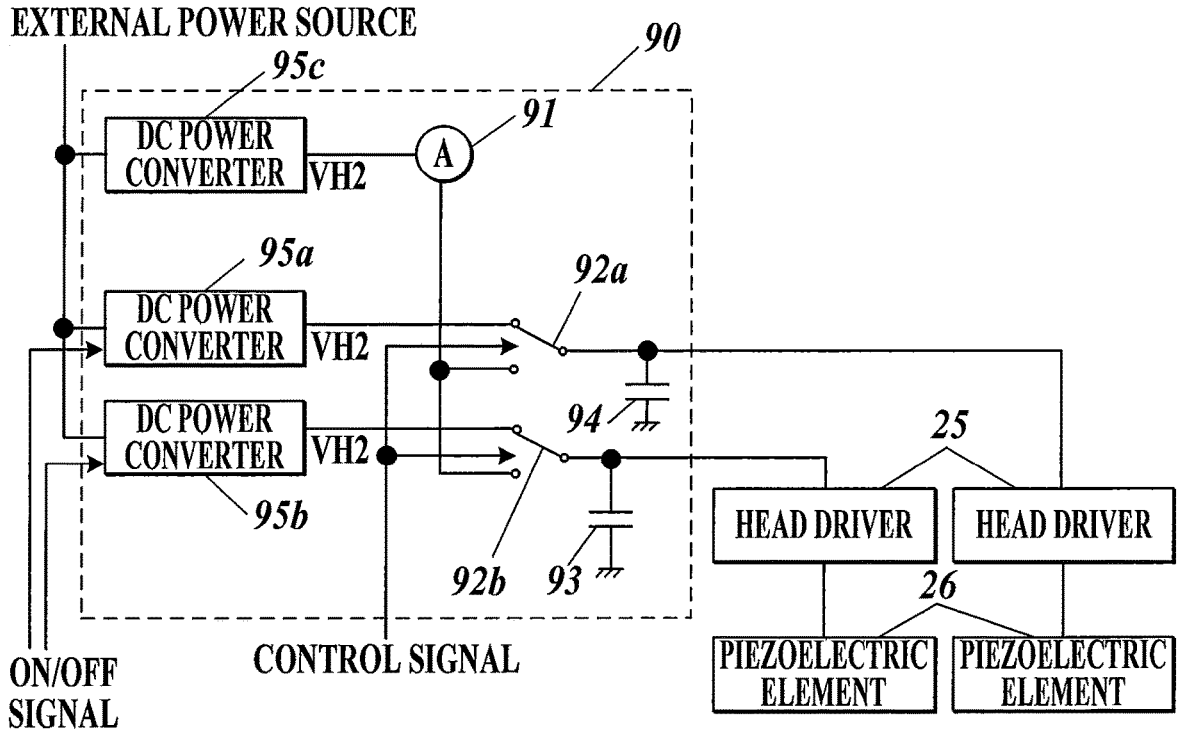
FIG. 10B illustrates a power unit according to a modification.

In a second modification illustrated in FIG. 10B, the switching elements 92*a* and 92*b* are switched in response to a common control signal and the power supply operation of the DC power converters 95*a* and 95*b* can be turned on/off, unlike the first modification. The input to the head drivers 25 can be readily switched between a normal driving signal and an inspection signal. The driver circuit 254 selectively operates the first switch 251 or the third switch 253 to inspect the target piezoelectric element 26, as described in the embodiment described above.

Figure 11A:
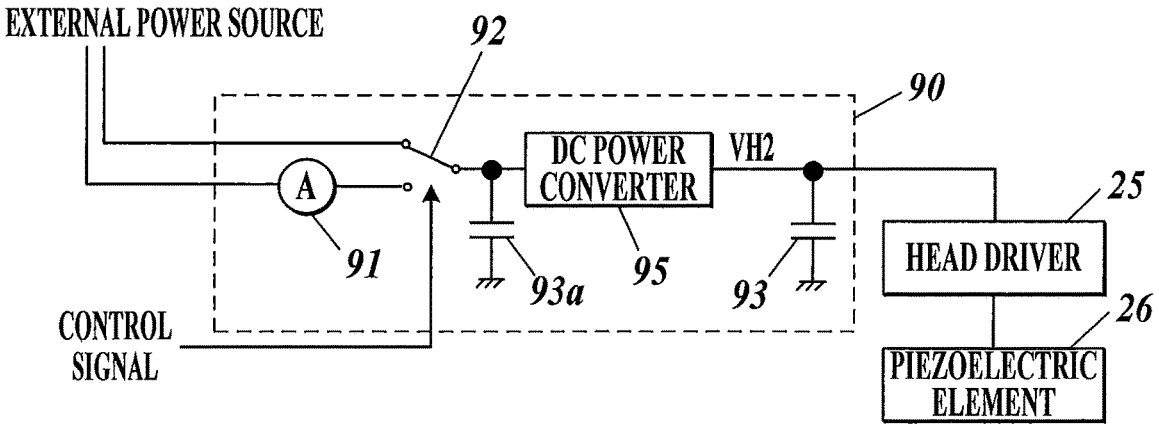
FIG. 11A illustrates a power unit according to a modification.

In a third modification illustrated in FIG. 11A, an external power source (for example, a 24-V DC power source) supplies power to the DC power converter 95 through two inputs, one of which is connected to the current detector 91; and a capacitor 93*a* has one terminal connected to a node between a resistive element of the current detector 91 and the DC power converter 95 and another terminal grounded. The switching element 92 (input switch) switches the power to the DC power converter 95 between a direct input and an input through the current detector 91. The input current to the DC power converter 95 can be measured (in this modification, the input current can be similarly measured on the basis of a voltage drop at the resistive element of the current detector 91) to determine a current input to a piezoelectric element 26 smoothened (passed through a low band) in accordance with the resistance of the resistive element and the electric capacitance of the capacitor 93*a* (i.e., a voltage fluctuation in a low frequency band). Thus, the capacitance Cp of the piezoelectric element 26 can be readily calculated.

In such a case, the current consumed during the operation of the DC power converter 95 is added as an offset value. Thus, the capacitance Cp should be calculated after deduction of the offset value. The operation of the DC power converter 95, i.e., the consumed power during an inspection of a piezoelectric element 26 is presumed to not vary. Thus, the offset value can be a constant value.

Figure 11B:
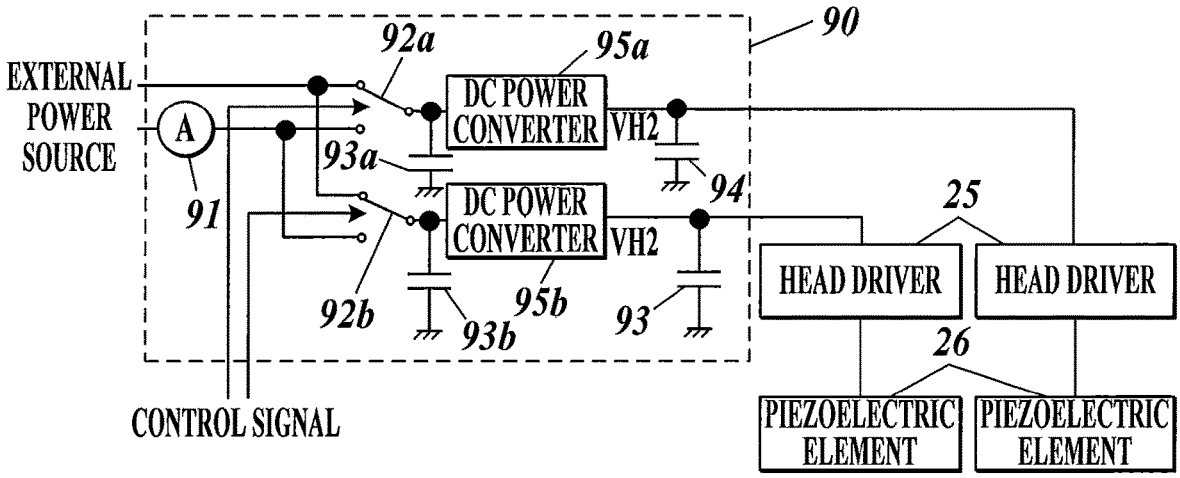
FIG. 11B illustrates a power unit according to a modification.

In a fourth modification illustrated in FIG. 11B, a current detector 91 measures a common current input to multiple DC power converters 95*a* and 95*b* corresponding to multiple head drivers 25. Switching elements 92*a* and 92*b* switch the power input to the DC power converters 95*a* and 95*b*, respectively, between a direct input and an input through the current detector 91 in response to individual control signals. Thus, the current detector 91 detects only a current smoothened by one of the capacitors 93*a* and 93*b* and corresponding to the power fed from one of the head drivers 25 to a corresponding piezoelectric element 26. The other piezoelectric elements 26 receive power without through the current detector 91.

Figure 11C:
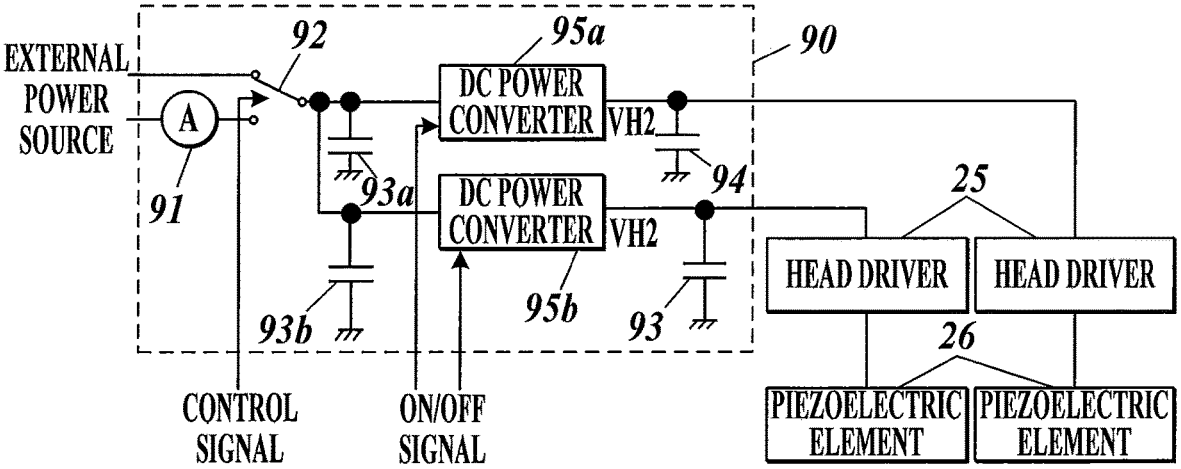
FIG. 11C illustrates a power unit according to a modification.

In a fifth modification illustrated in FIG. 11C, a single switching element 92 switches the power input from an external source to DC power converters 95*a* and 95*b* between a direct input and an input through a current detector 91. Both the DC power converters 95*a* and 95*b* receive power through the selected input, unlike the fourth modification. The DC power converters 95*a* and 95*b* each receive a signal for controlling the on/off mode of a voltage output (turning on/off of the output).

In detail, in the case of an inspection of the capacitance Cp of only a piezoelectric element 26 receiving power from a head driver 25, the switching element 92 selects an input through the current detector 91, and the voltage output from head drivers 25 other than the head driver 25 in association with the target piezoelectric element 26 is turned off. This merely requires a simple on/off control (turning on/off of the output) without an increase in the number of switch control signals in proportion to the number of the DC power converters 95. Thus, the traces for the switch control are simplified.

Figure 12A:
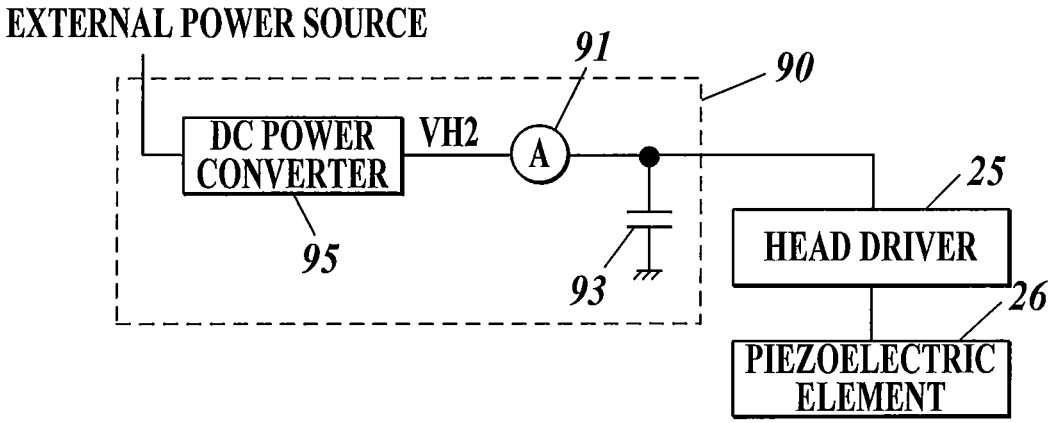
FIG. 12A illustrates a power unit according to a modification.
Figure 12B:
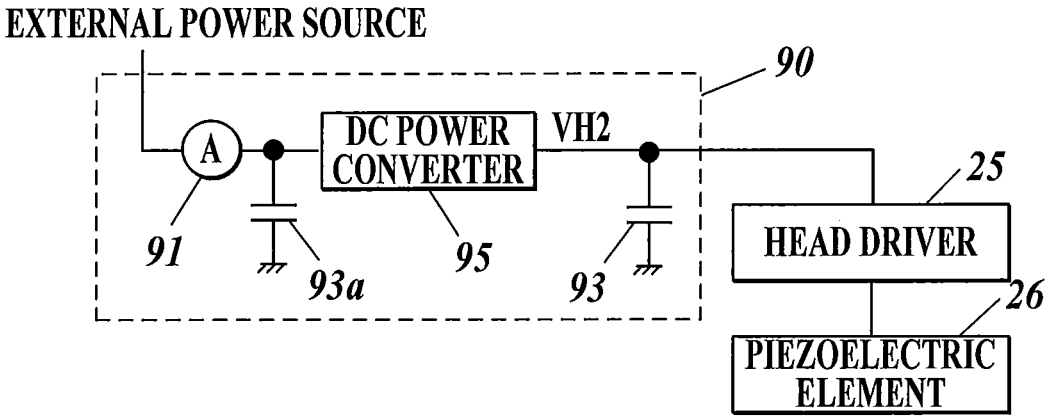
FIG. 12B illustrates a power unit according to a modification.

In sixth and seventh modifications illustrated in FIGS. 12A and 12B, respectively, the current detector 91 cannot be bypassed, unlike the embodiment and the first to fifth modifications described above. In specific, in the sixth modification illustrated in FIG. 12A, the voltage VH2 from the DC power converter 95 is applied to a first stabilizing capacitor 93 and a head driver 25 always through the current detector 91. In the seventh modification illustrated in FIG. 12B, the power from an external source is fed to the DC power converter 95 always through the current detector 91.

In such a case, application of a large current during normal driving of a piezoelectric element 26 causes a large voltage drop at the resistive element of the current detector 91. Thus, the inkjet recorder 1 may include a small number of nozzles or piezoelectric elements 26 to avoid a large voltage drop or to appropriately adjust the voltage drop at the DC power converter 95.

As described above, the inkjet recorder 1 according to this embodiment includes a nozzle 27 that ejects ink; a piezoelectric element 26 that deforms in response to an applied voltage and applies varied pressure to the ink supplied to the nozzles 27; a power unit 90 that supplies power for application of a driving voltage to the piezoelectric element 26; and a controller 40 including a processor that cyclically applies the driving voltage in accordance with a predetermined driving voltage pattern to the piezoelectric element 26, acquires a representative value corresponding to the power fed to the power unit 90 in association with the application of the driving voltage, and detects an abnormal capacitance Cp of the piezoelectric element 26 determined on the basis of the representative value.

In this way, a representative value of the power supplied by the power unit 90 is acquired through application of a driving voltage having a cyclic pattern for inspection without measurement of variations in the voltage and current applied to the piezoelectric element 26, to lower the level of accuracy required for detection. Thus, a malfunction in the driving operation in association with ink ejection from a nozzle can be readily identified without a sophisticated configuration and an advanced and/or complicated process.

The controller 40 (processor) acquires a representative value corresponding to variable components (including a DC component) in a predetermined low frequency band in the power supplied from the power unit 90 for the application of a driving voltage and detects an abnormal capacitance Cp of the piezoelectric element 26 determined on the basis of the representative value. A representative value may be a value determined on the basis of the electric capacitance of the first stabilizing capacitor 93 and the resistance of the resistive element of the current detector 91 among variable components in a low frequency band, i.e., variable components (including a DC component) of the power supplied by the DC power converter 95 as a result of the switching of the charge/discharge of the first stabilizing capacitor 93 in accordance with the on/off state of the first switch 251. Thus, highly accurate values can be readily acquired without high-speed calculation. In this way, defects in the driving operation can be readily and certainly identified.

The predetermined driving voltage pattern has a non-ejection waveform that does not cause ejection from the nozzles 27. Thus, ink is not consumed during application of a voltage with a cyclic inspection driving pattern, thereby reducing the cost and the trouble involving treatment of the ejected ink. Such a non-ejection waveform is generated merely from the voltage VH2. Thus, a complicated process, such as fine control of the voltage, is not required.

The power unit 90 includes a DC power converter 95 that receives power and outputs a predetermined driving voltage (voltage VH2); and a first stabilizing capacitor 93 that stores power corresponding to the predetermined driving voltage output from the DC power converter 95 and supplies the stored power to the piezoelectric element 26. The head driver includes a first switch 251 that switches the connection between the first stabilizing capacitor 93 and the piezoelectric element 26. In the case where the controller 40 (processor) detects an abnormal capacitance Cp, the time constant in association with the charge of the first stabilizing capacitor 93 by the DC power converter 95 while a connection is not established by the first switch 251 is larger than the time constant in association with the charge of the piezoelectric element 26 by the first stabilizing capacitor 93 while a connection is established by the first switch 251.

In detail, the charging rate of the first stabilizing capacitor 93 is smaller than the charging rate of the piezoelectric element 26. Thus, the power from the DC power converter 95 supplied for the charge of the first stabilizing capacitor 93 can be measured at the power unit 90, to readily enhance the measurement accuracy. The cyclic power supply leads to ready acquisition of the average supplied power. In particular, the time constant in association with the charge of the first stabilizing capacitor 93 that can apply a driving voltage to multiple piezoelectric elements 26 (i.e., can apply a driving voltage with a significantly small voltage drop) is significantly larger than the time constant in association with the charge of the piezoelectric elements 26. Thus, an output of a driving voltage waveform at an appropriate frequency causes the current output from the DC power converter 95 to approximate a steady current. Thus, the capacitance Cp can be readily estimated through one to several measurements of a representative value (output current Ib).

The power unit 90 includes a current detector 91 that measures the current output from the DC power converter 95 as a representative value on the basis of a voltage drop at the resistive element of the current detector 91 having a predetermined resistance. One of the terminals of the first stabilizing capacitor 93 is connected to a node between the terminal of the resistive element of the current detector 91 and the switching element 92. The current detector 91 measure a voltage variation in the predetermined low frequency band corresponding to the resistance of the resistive element and the electric capacitance of the first stabilizing capacitor 93.

A typical current detector measures a voltage drop in a resistive element. The resistive element connected to a circuit causes the time constant in association with the charge of the first stabilizing capacitor 93 to significantly increase due to the resistance of the resistive element and the electric capacitance of the first stabilizing capacitor 93. Thus, the current detector 91 measures a smoothened voltage variation in the low frequency band, thereby enabling ready acquisition of an average current value Ir at high accuracy. In specific, the inkjet recorder 1 can readily and certainly detect a defect in a piezoelectric element 26.

The power units 90 according to the third to fifth modifications each include a current detector 91 that measure the current input to a DC power converter 95. A terminal of a capacitor 93*a* is connected to a node between a resistive element of the current detector 91 and the DC power converter 95. The current detector 91 measures a voltage variation in a predetermined low frequency band corresponding to the resistance of the resistive element and the electric capacitance of the capacitor 93*a*.

Also, in the case of detection of the current input to the DC power converter 95, an average current value Ir corresponding to the power supplied from the current detector 91 to the piezoelectric element 26 can be readily acquired.

Thus, a defect in a piezoelectric element 26 can be readily and appropriately detected, as in the embodiment described above.

In the inkjet recorder 1, a short circuit is disposed in parallel to the current detector 91 (resistive element) of the power unit 90. The inkjet recorder 1 further includes a measurement circuit connected to the current detector 91 and the switching element 92 that switches between the measurement circuit and the short circuit. The switching element 92 switches to the short circuit when an abnormal capacitance Cp is not detected. As described above, a large current input to the resistive element causes a large voltage drop. A current input to the current detector 91 during normal driving of a typical piezoelectric element 26 may adversely affect the driving voltage. An increase in the current may cause an increase in heat generation that affects other components and may reduce the service life of the image recorder 20. In the case where a short circuit that supplies power to the piezoelectric element 26 without through the current detector 91 is disposed in parallel to the current detector 91 and the piezoelectric element 26 is not inspected, the switching element 92 switches to the short circuit to avoid the adverse effects described above.

The power units 90 according to the first and second modifications each includes DC power converters 95*a*, 95*b*, and 95*c* that receive power and output predetermined driving voltages; a current detector 91 that measures the output current from the DC power converter 95*c*; switching elements 92*a* and 92*b* that switch between a driving voltage output from the DC power converter 95*c* and a driving voltage output from the DC power converter 95*a* or 95*b*; and a first stabilizing capacitor 93 that stores power corresponding to the voltage output from the switching element 92*a* or 92*b* and supplies the stored power to the piezoelectric element 26. The power unit 90 measures the voltage variation in the predetermined low frequency band described above corresponding to the resistance of the resistive element of the current detector 91 and the electric capacitance of the first stabilizing capacitor 93.

The different DC power converters are used for inspection of the capacitance Cp and regular driving under appropriate loads so as to achieve appropriate operation. In particular, multiple DC power converters for the normal driving operation of multiple piezoelectric elements 26 may be used together with a DC power converter for inspection of the piezoelectric elements 26 to efficiently carry out both the driving operation and the inspection.

The inkjet recorder 1 provided with the power unit 90 according to the fourth modification includes two or more predetermined number of groups of piezoelectric elements 26 and nozzles 27; a short circuit disposed in parallel to a current detector 91 (and its resistive element); and switching elements 92*a* and 92*b* each switching between a measurement circuit connected to the current detector 91 and the short circuit. The power unit 90 includes the predetermined number of DC power converters 95*a* and 95*b* that output a predetermined driving voltage to each group of piezoelectric elements. The switching elements 92*a* and 92*b* switch the power input to the predetermined number of the DC power converters 95*a* and 95*b* between a route through the measurement circuit and a route through the short circuit.

In the case where the DC power converters corresponding to the groups of piezoelectric elements are provided as described above, the switching elements 92*a* and 92*b* switch between the short circuit and the measurement circuit, which are in parallel, to supply power to the DC power converters. In this way, an inspection of the capacitances Cp of the piezoelectric elements 26 receiving power from one of the DC power converters can be conducted while appropriate power is readily supplied to the DC power converter corresponding to the target piezoelectric element 26 and the other DC power converter(s). The excess heat generation does not occur in the current detector 91. Thus, an appropriate voltage can be applied to the piezoelectric elements 26 without wasted power and heat generation, resulting in ready inspection of the target piezoelectric element 26.

An inkjet recorder 1 provided with the power unit 90 according to the fifth modification includes two or more predetermined number of groups of piezoelectric elements 26 and nozzles 27; a short circuit disposed in parallel to a current detector 91 (and its resistive element); and a switching element 92 switching between a measurement circuit connected to the current detector 91 and the short circuit. The power unit 90 includes the predetermined number of DC power converters 95*a* and 95*b* that output a predetermined driving voltage to the respective groups of piezoelectric elements. The output of a predetermined driving voltage from the DC power converters 95*a* and 95*b* to the groups of piezoelectric elements can be turned on/off.

The switching element 92 switches the power inputs to all the groups of piezoelectric elements between a route through the short circuit and a route through the measurement circuit, as described above. This simplifies the traces and output of control signals. Only one or limited number of target piezoelectric elements 26 can be inspected in a single operation, and detection of power (currents) simultaneously supplied to all the DC power converters 95*a* and 95*b* by the current detector 91 is not particularly advantageous. Thus, the driving voltage from the DC power converters other than those supplying power to the target piezoelectric element 26 can be turned off to reduce wasted power consumption. The traces for turning on/off the output are simpler than the traces for switching between sources (power units) in response to control signals, which are also simple signals. This simplifies the configuration and structure of the power unit 90.

The controller 40 (processor) cyclically applies a driving voltage and then determines a representative value after a predetermined standby time trms.

As described above, the cyclically applied driving voltage only slightly varies. Relative to this variation, the charging rate to the first stabilizing capacitor 93, i.e., the output current Ib undergoes a relatively large variation. Thus, after the charging rate is equilibrated with the discharging rate from the first stabilizing capacitor 93 to the piezoelectric element 26, the output current Ib can be readily and accurately determined, resulting in an increased accuracy of detection of an abnormal capacitance Cp.

The standby time trms, which is determined on the basis of the capacitance of the first stabilizing capacitor 93 and the resistance of the resistive element of the current detector 91, can be preliminarily set to an appropriate value based on the capacitance and the resistance. In this way, the output current Ib can be readily and accurately determined.

The controller 40 (processor) determines the standby time trms during initialization in association with pre-shipment inspection of the inkjet recorder 1 or replacement of the head units 21 through measurement of the time required for the fluctuation in the values measured at the current detector 91 to stabilize within a predetermined reference range after the start of the cyclic application of a driving voltage for inspection. In this way, the output current Ib can be readily measured at an appropriate timing during the actual inspection, to certainly detect an abnormal capacitance Cp.

The inkjet recorder 1 includes a memory 50 that stores the data of the standby time trms as standby time setting 55. The controller 40 (processor) detects an abnormal capacitance Cp with reference to the standby time setting 55. In this way, the output current Ib can be readily measured at an appropriate timing during the inspection, to certainly detect an abnormal capacitance Cp.

The controller 40 (processor) starts cyclic application of a driving voltage for inspection and then determines the output current Ib once the fluctuation in the values measured by the current detector 91 stabilize within a predetermined reference range. In this way, the output current Ib can be appropriately determined at an appropriate timing based on actual measurements without preliminary inspection and storing of the standby time trms, to certainly detect an abnormal capacitance Cp.

The controller 40 (processor) instructs the ink ejection of at least some of the nozzles adjacent to a defective nozzle ejecting ink in response to deformation of the corresponding piezoelectric element 26 having an abnormal capacitance Cp, to supplement the volume of ink that was to be ejected from the defective nozzle.

This supplementary ink ejection can identify ejection failure, in particular, non-restorable nozzles having electrical defects, and thus can maintain appropriate image quality through supplementary ink ejection while avoiding unnecessary cleaning.

The inkjet recorder 1 includes a memory 50 that stores a defective nozzle list 52 and an operation receiving and displaying unit 80 that carries out a predetermined announcement operation. The controller 40 (processor) instructs an announcement operation when a predetermined condition involving defective nozzles is satisfied, for example, when the defective nozzles are continuously arrayed, or the number of defective nozzles exceeds a reference number.

In this way, the inkjet recorder 1 can promptly announce to a user that supplementary ink ejection cannot maintain high image quality. Thus, low image quality can be promptly and appropriately prevented, and images can be efficiently recorded with stable quality.

The memory 50 stores the historical capacitance data 54 in association with the average current values Ir of each nozzle 27. The controller 40 (processor) determines the degradation of the piezoelectric elements 26 on the basis of the temporal variation in the average current value Ir. In this way, aging degradation can be readily determined, as well as the defective piezoelectric elements 26. Thus, the driving voltage can be readily adjusted, and the replacement timing of the ejection heads 211 can be appropriately determined. This can further reduce cost and trouble.

The controller 40 (processor) controls the driving voltage applied to multiple piezoelectric elements 26 in accordance with image data on images to be recorded and detects ejection failure of ink from multiple nozzles 27 on the basis of the results of a read predetermined test image (ejection-failure testing image) formed onto a recording medium P by ink ejected from the nozzles 27, under the control in accordance with the image data on the ejection-failure testing image. The inkjet recorder 1 includes a cleaner 30 that cleans the nozzle face 210 having arrays of openings of the nozzles 27. In the case where the nozzles having ejection failure are not caused by defective nozzles, the controller 40 (processor) instructs the cleaner to clean the nozzle face 210 under a predetermined condition, such as a certain number of nozzles having ejection failure.

In this way, the inkjet recorder 1 can detect the abnormal capacitances of the piezoelectric elements 26 and find the ink ejection failure using a test image by a conventional means, to determine the timing of cleaning of the nozzle face 210 through simple inspections. Thus, the inkjet recorder 1 can promptly return to an appropriate operational state without complicated processing.

The inkjet recorder 1 includes a reader 60 that reads an ejection-failure testing image recorded on a recording medium P. In this way, an inspection of ink ejection failure can be readily conducted in parallel to the recording of images. This promptly detects ink ejection failure and a reduction in quality of recorded images.

The predetermined driving voltage pattern has a non-ejection waveform that does not cause ejection from the nozzles 27. This reduces the volume of ink consumed during the inspection, in particular, the volume of ink continuously ejected in response to cyclic application of a driving voltage. Defective nozzles (abnormal capacitance of piezoelectric elements) can be readily and appropriately detected during a short recording time without a separate operation for collection of the ejected ink into, for example, a waste tray. Thus, the recording operation is not interrupted for a long time, thereby increasing work efficiency. In such a case, the entire power consumed or supplied by the power unit 90 (average current value Ir) can be maintained at an appropriate level through the cyclic application of a driving voltage at a switching frequency f even with a decrease in the amplitude of the driving voltage having a non-ejection waveform. Thus, fine adjustment is not required for acquisition of desired measured results. This reduces the trouble of the inspection.

The power unit 90 includes a DC power converter 95 that receives power and outputs a predetermined driving voltage; a first stabilizing capacitor 93 that stores power corresponding to the output voltage and supplies the stored power to a piezoelectric element 26; and a first switch 251 that switches the connecting state between the first stabilizing capacitor 93 and the piezoelectric element 26. During detection of an abnormal capacitance Cp by the controller 40 (processor), the time constant in association with the charge of the first stabilizing capacitor 93 by the DC power converter 95 while a connection is not established by the first switch 251 is larger than the time constant in association with the charge of the piezoelectric element 26 by the first stabilizing capacitor 93 while a connection is established by the first switch 251.

In specific, the first stabilizing capacitor 93, which has a capacitance significantly larger than that of the piezoelectric element 26, is connected to both the DC power converter 95 and the piezoelectric element 26 with a large time constant, to smoothen the current Ib output from the DC power converter 95 and maintain the drop in the output voltage Vb within a minute range. Thus, a measurement of the power (i.e., the average current value Ir) is easier than a measurement of the voltage applied to the piezoelectric element 26. This readily determines an abnormal capacitance of the piezoelectric element 26.

The power unit 90 includes a current detector 91 that determines the current Ib output from the DC power converter 95 as an average current value Ir based on a voltage drop due to a resistive element having a predetermined resistance; and a switching element 92 that switches between a measurement route of the output current Ib through the resistive element and a direction route of the output current Ib bypassing the resistive element. The controller 40 (processor) outputs the current Ib through the measurement route to detect an abnormal capacitance Cp and outputs the current Ib through the direct route when an abnormal capacitance Cp is not inspected.

In this way, the resistive element of the current detector 91 contributes to an increase in the time constant when the first stabilizing capacitor 93 is charged with the output current Ib. Thus, an abnormal capacitance of the piezoelectric element 26 can be readily detected without an additional configuration. In the case where a driving voltage is applied to all the piezoelectric elements 26 corresponding to the nozzles 27, the resistive element causes an increase in the power consumption and a drop in the driving voltage. Thus, the current detector 91 should be bypassed during power supply for normal driving, to appropriately deform the piezoelectric elements 26 while preventing an increase in power consumption through a simple configuration. This prevents adverse effects on the quality of the recorded image.

The controller 40 (processor) determines the average current value Ir after a predetermined standby time from the start of application of the driving voltage in a predetermined driving voltage pattern. After the start of cyclic application of a driving voltage, a slight delay time is required for the output current Ib to stabilize in the vicinity of the average current value Ir depending on the capacity of the first stabilizing capacitor 93 and the applied voltage. The average current value Ir is determined after a standby time trms in consideration of the delay time, to appropriately detect a capacitance Cp (defective nozzle).

The controller 40 (processor) determines the average current value Ir after the difference between the discharging rate of the first stabilizing capacitor 93 in association with the charge of the piezoelectric element 26 and the charging rate of the first stabilizing capacitor 93 in association with the charge of the first stabilizing capacitor 93 becomes smaller than or equal to a predetermined reference value.

In this way, the standby time trms can be sufficiently small (several tens of msec, for example) for the inkjet recorder 1. Thus, prompt inspection can be conducted without an adverse effect on the recording operation.

The controller 40 (processor) determines the average current value Ir through calculation of the average of the measured values of the output current Ib. As described above, the output current Ib varies relative to a minute fluctuation in the voltage of the first stabilizing capacitor 93 even when the capacitance of the first stabilizing capacitor 93 is significantly greater than the capacitance Cp and affects the calculation of the capacitance Cp. Thus, the average current value Ir can be accurately determined on the basis of the average output current Ib to appropriately determine the capacitance Cp.

The controller 40 (processor) detects abnormal capacitances Cp between repetitive image recording operations.

Abnormal capacitances can be detected between normal recording operations to time-efficiently detect defective nozzles. The defect detection conducted after every recording operation leads to prompted detection of a defect, thereby enabling immediate interruption of the image recording and processing to maintain the image quality. This efficiently reduces the useless recording media, ink, and time consumed through continuous recording of low quality images.

The detection operation of abnormal capacitances Cp of multiple piezoelectric elements 26 is carried out in parts during several intervals between recording operations. It may be difficult to inspect all the piezoelectric elements 26 for abnormal capacitances Cp during short time intervals between the recording operations depending on the number of nozzles. In such a case, the piezoelectric elements 26 may be categorized into groups to promptly inspect all piezoelectric elements 26 and identify the defective nozzles.

A method of detecting a malfunction according to this embodiment includes malfunction detecting steps (steps S104, S106, and S107) of cyclically applying a driving voltage in a predetermined driving voltage pattern to a piezoelectric element 26, determining an average current value Ir or representative value of the variable components (including a DC component) in a predetermined low frequency band in the power supplied from a power unit 90 applying the driving voltage, and detecting an abnormal capacitance Cp of the piezoelectric element 26 on the basis of the representative value.

Such a method of detecting a malfunction can reduce the level of requirement on detection accuracy of the abnormal capacitance Cp. Thus, a malfunction of the driving operation on the ejection of ink from a nozzle can be readily identified without a sophisticated configuration and an advanced and/or complicated process.

The present invention should not be limited to the embodiments described above and may include various modifications.

For example, in the embodiment above, the currents input to and output from the DC power converter 95 are measured at the current detector 91. Alternatively, any value that can be used for the calculation of the supplied power may be determined. For example, the value may be a voltage, such as an output voltage Vb, or a variation in the voltage.

In the embodiment described above, a driving voltage (voltage VH2) having a rectangular waveform that simply alternates between on and off states of the driving voltage is used for inspection. Alternatively, the capacitance Cp of the piezoelectric element may be inspected with a trapezoidal waveform in the present invention.

In the embodiment described above, a voltage VH2 that does not cause ejection of ink is applied to detect abnormal capacitances Cp without ejection of ink (non-ejection). Alternatively, even in a voltage (such as a voltage VH1) causing ejection of ink in a normal driving operation, the frequency of the voltage may be varied to a higher side that does not cause deformation of the piezoelectric element 26 and/or does not cause ink in an ink channel to respond with the deformation of a pressure chamber (variation in pressure), to acquire a non-ejection waveform and detect malfunctions in circuits in association with application of the voltage (such as the voltage VH1). Such a high frequency causes frequent output of the current Ia to the piezoelectric element 26. This increases the average current value Ir, thereby facilitating the measurements. Alternatively, abnormal capacitances Cp may be detected during ink ejection to detect malfunctions in circuits in association with application of such an ejection voltage.

The embodiment described above uses the capacitance of the first stabilizing capacitor 93 of the power unit 90 and the smoothening of the power due to the resistive element of the current detector 91 and the resistances of the circuits. Alternatively, induction components of the DC power converter 95 and/or other components may be used. If the circuit has a sufficient resistance, the current detector 91 need not include a measurement circuit and a resistive element disposed in series.

In the embodiment described above, the route of the output current Ib is switched between a measurement route for measuring the output current Ib and a direct or bypass route not for measuring the output current Ib. The measurements described above are conducted in consideration of delay and smoothening of the output currents in accordance with the capacitance of the first stabilizing capacitor 93 and the resistance of the resistive element of the current detector 91. Alternatively, the measurements may be conducted in consideration of inductance of the DC power converter 95.

The embodiment described above describes a cleaning operation of wiping foreign objects attached to the ink ejection face. Other operations may be further performed, for example, ejection of air bubbles and/or foreign objects from the nozzles or back-flow of air bubbles and/or foreign objects from the ejection heads 211 to an ink tank.

In the embodiment described above, the inkjet recorder 1 includes a reader 60. Alternatively, the inkjet recorder 1 may be provided with an external reader. Nozzles having ejection failure may be detected by an external unit and the detected results may be sent to the controller 40.

Alternatively, the degradation may be determined on the basis of a mere comparison of the current value with the initial value, without the historical capacitance data 54. Alternatively, mere defects, such as mechanical failure, may be detected without assessment of the state of degradation.

In the embodiment described above, the inkjet recorder includes a line head that records images on continuous recording medium through a single-pass operation. Any other recorder may also be used. The inkjet recorder may be a scanning inkjet recorder that alternatingly repeats the convey of the recording medium P and the ejection of ink onto the recording medium P while the ejection heads 211 is moved relative to the recording medium P in a stationary state. The recording medium may be any type of recording medium besides a continuous recording medium. An example of such a recording medium is at least one cut paper sheet on which one or more target images are to be recorded. In such a case, detection of a malfunction without ink ejection may be carried out during intervals between the recording media.

The detailed configuration, circuit arrangement, processes, and steps of the embodiments described above may be appropriately modified without departing from the scope of the present invention.

What is claimed is:

1. An inkjet recorder comprising:

at least one nozzle ejecting ink;

at least one piezoelectric element deforming in response to an applied voltage and causing a change in pressure of ink to be supplied to the nozzle;

a power unit supplying power for application of a driving voltage to the piezoelectric element; and a processor cyclically applying the driving voltage in accordance with a predetermined driving voltage pattern to the piezoelectric element, acquiring a representative value corresponding to an average value of the power supplied by the power unit in response to the application of the driving voltage, and detecting an abnormal capacitance of the piezoelectric element determined based on the representative value.

2. The inkjet recorder according to claim 1, wherein the processor acquires a representative value corresponding to a variable component in a predetermined low frequency band in the power supplied from the power unit.

3. The inkjet recorder according to claim 2, wherein the predetermined driving voltage pattern has a non-ejection waveform not causing ejection of ink from the nozzle.

4. The inkjet recorder according to claim 2, further comprising:

a first switch switching a connection between a capacitor and the piezoelectric element, wherein the power unit comprises:

at least one driving-voltage outputting unit receiving power and outputting a predetermined driving voltage; and the capacitor storing power based on the predetermined driving voltage output from the driving-voltage outputting unit and supplying the stored power corresponding to the predetermined driving voltage to the piezoelectric element, and wherein a time constant in association with a charge of the capacitor by the driving-voltage outputting unit while the connection is not established by the first switch is larger than a time constant in association with a charge of the piezoelectric element while the connection is established by the first switch, while the processor detects the abnormal capacitance.

5. The inkjet recorder according to claim 4, wherein the power unit comprises an ammeter measuring a current output from the driving-voltage outputting unit as the representative value based on a voltage drop due to a resistive element having a predetermined resistance, wherein a terminal of the capacitor is connected to a node between a terminal of the resistive element and the first switch, and wherein the ammeter measures a varied voltage in the predetermined low frequency band corresponding to a resistance of the resistive element and an electric capacitance of the capacitor.

6. The inkjet recorder according to claim 5, wherein the power unit comprises:

a short circuit disposed in parallel to the resistive element; and a second switch switching between a measurement circuit through the ammeter and the short circuit, and wherein the second switch switches to the short circuit while an abnormal capacitance is not detected.

7. The inkjet recorder according to claim 5, wherein the processor acquires the representative value after a predetermined standby time from a start of cyclic application of the driving voltage, the standby time being determined based on a capacitance of the capacitor and a resistance of the resistive element of the ammeter.

8. The inkjet recorder according to claim 5, wherein the processor determines a predetermined standby time during predetermined initialization through measurement of time from a start of cyclic application of the driving voltage until a fluctuation in a value measured by the ammeter is within a predetermined reference range, and wherein the processor acquires the representative value after a predetermined standby time from a start of cyclic application of the driving voltage.

9. The inkjet recorder according to claim 5, wherein the processor acquires the representative value based on a value which is measured by the ammeter and fluctuates within a predetermined reference range after a start of cyclic application of the driving voltage.

10. The inkjet recorder according to claim 4, wherein the power unit comprises an ammeter measuring a current input to the driving-voltage outputting unit as the representative value based on a voltage drop due to a resistive element having a predetermined resistance, wherein a terminal of the capacitor is connected to a node between the resistive element and the driving-voltage outputting unit, and wherein the ammeter measures a varied voltage in the predetermined low frequency band corresponding to a resistance of the resistive element and an electric capacitance of the capacitor.

11. The inkjet recorder according to claim 10, further comprising:

a short circuit disposed in parallel to the resistive element; and a second switch switching between a measurement circuit through the ammeter and the short-circuit, wherein the at least one piezoelectric element comprises a plurality of piezoelectric elements categorized into a predetermined number of groups and the at least one nozzle comprises a plurality of nozzles, wherein the power unit comprises the at least one driving-voltage outputting unit comprising the predetermined number of driving-voltage outputting units, and outputs the predetermined driving voltage in association with each of the piezoelectric-element groups, and wherein the second switch selects one of the measurement circuit and the short circuit to supply power in each of the predetermined number of the driving-voltage outputting units.

12. The inkjet recorder according to claim 10, further comprising:

a short circuit disposed in parallel to the resistive element; and a second switch switching between a measurement circuit through the ammeter and the short circuit, wherein the at least one piezoelectric element comprises a plurality of piezoelectric elements categorized into a predetermined number of groups and the at least one nozzle comprises a plurality of nozzles, wherein the power unit comprises the at least one driving-voltage outputting unit comprising the predetermined number of driving-voltage outputting units and outputs the predetermined driving voltage in association with each of the piezoelectric-element groups, and wherein the predetermined number of the driving-voltage outputting units turn on and off the output of the predetermined driving voltages in association with each of the groups of the piezoelectric elements.

13. The inkjet recorder according to claim 2, wherein the power unit comprises:

a first driving-voltage outputting unit and a second driving-voltage outputting unit each receiving power and outputting a predetermined driving voltage;

an ammeter measuring a current output from the first driving-voltage outputting unit as the representative value based on a voltage drop across a resistive element having a predetermined resistance;

an input switch selecting one of a driving voltage output by the first driving-voltage outputting unit and the driving voltage output by the second driving-voltage outputting unit; and a capacitor storing power based on the predetermined driving voltage output from the input switch and supplying the stored power corresponding to the predetermined driving voltage to the piezoelectric element, and wherein a varied voltage in the predetermined low frequency band is measured corresponding to a resistance of the resistive element and an electric capacitance of the capacitor.

14. The inkjet recorder according to claim 2, wherein the processor acquires the representative value after a predetermined standby time from a start of cyclic application of the driving voltage.

15. The inkjet recorder according to claim 14, further comprising:

a memory storing data on the standby time, wherein the processor detects the abnormal capacitance with reference to the data on the standby time.

16. The inkjet recorder according to claim 1, wherein the at least one nozzle comprises an array of nozzles, wherein the piezoelectric element comprises a plurality of piezoelectric elements respectively applying a varied pressure to ink supplied to each of the nozzles, and wherein the processor instructs, in response to deformation of the piezoelectric element having the abnormal capacitance, at least some of the nozzles adjacent to a defective nozzle ejecting ink so that the volume of ink to be ejected from the defective nozzle is supplemented.

17. The inkjet recorder according to claim 16, further comprising:

a defective-nozzle storage storing information on the defective nozzle; and an announcement unit performing a predetermined announcement operation, wherein the processor instructs the announcement unit to carry out the predetermined announcement operation if the detected defective nozzle satisfies a predetermined condition.

18. The inkjet recorder according to claim 16, further comprising:

a history storage storing history on the representative value for each of the nozzles, wherein the processor determines degradation of the piezoelectric elements based on a temporal variation in the representative value.

19. The inkjet recorder according to claim 16, further comprising:

a cleaner cleaning a nozzle face having an array of openings of the nozzles, wherein the processor controls application of the driving voltage to the piezoelectric elements in accordance with image data of an image to be recorded, wherein the processor detects an ink ejection failure of the nozzles based on a result of reading a predetermined ejection-failure testing image formed onto a recording medium by ink ejected from the nozzles, under a control in accordance with image data on the ejection-failure testing image, and wherein the processor instructs the cleaner to clean the nozzle face under a predetermined condition if there is a nozzle having the ejection failure other than the defective nozzle.

20. The inkjet recorder according to claim 19, further comprising a reader reading the ejection-failure testing image recorded on a recording medium.

21. The inkjet recorder according to claim 16, wherein the predetermined driving voltage pattern has a non-ejection waveform not causing ejection of the ink from the nozzles.

22. The inkjet recorder according to claim 16, wherein the power unit comprises:

a driving-voltage outputting unit receiving power and outputting a predetermined driving voltage;

a capacitor storing power and supplying the stored power corresponding to the output predetermined driving voltage to the piezoelectric elements, and a first switch switching a connection between the capacitor and the piezoelectric elements, and wherein a time constant in association with a charge of the capacitor by the driving-voltage outputting unit while the connection is not established by the first switch is larger than a time constant in association with a charge of the piezoelectric element by the capacitor while the connection is established by the first switch, during detection of an abnormal capacitance by the processor.

23. The inkjet recorder according to claim 22, wherein the power unit comprises:

an ammeter measuring a current output from the driving-voltage outputting unit as the representative value based on a voltage drop across a resistive element having a predetermined resistance; and a second switch switching routes of the output current between a measurement route through the resistive element and a direct route bypassing the resistive element, and wherein the processor outputs the output current through the measurement route if the abnormal capacitance is detected and outputs the output current through the direct route if the abnormal capacitance is not detected.

24. The inkjet recorder according to claim 16, wherein the processor acquires the representative value after a predetermined standby time from a start of application of the driving voltage in accordance with the driving voltage pattern.

25. The inkjet recorder according to claim 22, wherein the processor acquires the representative value after the difference between a discharging rate of the capacitor in association with the charge of the piezoelectric elements and a charging rate of the capacitor during the charge of the capacitor is smaller than or equal to a predetermined reference value.

26. The inkjet recorder according to claim 25, wherein the processor acquires the representative value based on an average of measured values.

27. The inkjet recorder according to claim 16, wherein the processor controls application of a driving voltage to the piezoelectric elements in accordance with image data on an image to be recorded, and wherein, when recording operations of the image to be recorded are performed repeatedly, the processor detects an abnormal capacitance during intervals between the recording operations.

28. The inkjet recorder according to claim 27, wherein the detection operation of the abnormal capacitance of the piezoelectric elements is divided into several steps to be performed during intervals between the recording operations.

29. A method of detecting a malfunction of an inkjet recorder comprising a nozzle ejecting ink; a piezoelectric element deforming in response to an applied voltage and applying varied pressure to ink supplied to the nozzle; and a power unit supplying power for application of a driving voltage to the piezoelectric element, the method comprising a malfunction detection steps of:

cyclically applying a driving voltage in accordance with a predetermined driving voltage pattern to the piezoelectric element;

acquiring a representative value corresponding to a variable component in a predetermined low frequency band among power supplied by the power unit in association with application of the driving voltage; and detecting an abnormal capacitance in the piezoelectric element calculated from the representative value.

* * * * *